US005521606A

United States Patent [19]

Iijima et al.

[11] Patent Number: 5,521,606

[45] Date of Patent: May 28, 1996

[54] WINDOW GLASS ANTENNA FOR MOTOR VEHICLES

[75] Inventors: Hiroshi Iijima, Ibaraki; Jun Hasegawa, Tokyo; Eiichiro Kawasaki; Ryokichi Doi, both of Ibaraki, all of Japan

[73] Assignee: Nippon Sheet Glass Co., Ltd., Japan

[21] Appl. No.: 390,931

[22] Filed: Feb. 17, 1995

Related U.S. Application Data

[63] Continuation of Ser. No. 13,699, Feb. 4, 1993, abandoned.

[30] Foreign Application Priority Data

| | | | |
|---|---|---|---|
| Feb. 5, 1992 | [JP] | Japan | 4-012452 U |
| May 13, 1992 | [JP] | Japan | 4-038628 U |
| Nov. 12, 1992 | [JP] | Japan | 4-327369 |

[51] Int. Cl.[6] ..... H01Q 1/32

[52] U.S. Cl. ..... 343/713; 343/846

[58] Field of Search ..... 343/704, 713, 343/711, 712, 846, 847, 848, 828, 829, 830; H01Q 1/32

[56] References Cited

U.S. PATENT DOCUMENTS

| | | | |
|---|---|---|---|
| 4,721,964 | 1/1988 | Sato et al. | 343/713 |
| 4,757,322 | 7/1988 | Yokagawa et al. | 343/713 |
| 5,220,336 | 6/1993 | Hirotsu et al. | 343/713 |
| 5,255,002 | 10/1993 | Day | 343/713 |
| 5,264,858 | 11/1993 | Shiina | 343/713 |
| 5,293,174 | 3/1994 | Kropielnicki et al. | 343/713 |

FOREIGN PATENT DOCUMENTS

| | | | |
|---|---|---|---|
| 3265202 | 11/1991 | Japan . | |
| WO88/00569 | 12/1988 | WIPO | 343/713 |

*Primary Examiner*—Donald T. Hajec
*Assistant Examiner*—Tan Ho
*Attorney, Agent, or Firm*—Merchant, Gould, Smith, Edell, Welter & Schmidt

[57] ABSTRACT

A window glass antenna for use on an automobile rear window glass panel, for example has a radiating pattern to be mounted on the window glass panel a ground pattern to be mounted on the window glass panel in spaced relationship to the radiating pattern. The radiating pattern has a vertical length substantially equal to a quarter wavelength. The ground pattern has a vertical length substantially equal to a quarter wavelength and a horizontal width ranging from a half wavelength to a three-quarter wavelength.

35 Claims, 33 Drawing Sheets

870MHz

880MHz

890MHz

900MHz

910MHz

920MHz

930MHz

940MHz

870MHz

880MHz

890MHz

900MHz

910MHz

920MHz

930MHz

940MHz

870MHz

880MHz

890MHz

900MHz

910MHz

920MHz

930MHz

940MHz

FIG.38

| FREQUENCY (MHz) | W=70mm | W=60mm | W=50mm | W=40mm | W=30mm | W=20mm |
|---|---|---|---|---|---|---|
| 790 | -4.8 | -5.0 | -4.8 | -5.4 | -5.4 | -6.8 |
| 800 | -6.3 | -6.0 | -5.6 | -6.0 | -6.0 | -7.4 |
| 810 | -7.0 | -6.4 | -6.3 | -6.6 | -6.4 | -7.3 |
| 820 | -7.4 | -7.1 | -6.5 | -7.2 | -7.1 | -7.5 |
| 830 | -6.8 | -6.9 | -5.8 | -6.5 | -6.4 | -6.9 |
| 840 | -6.6 | -6.6 | -5.6 | -6.1 | -6.1 | -6.7 |
| 850 | -6.8 | -6.1 | -5.6 | -5.8 | -5.8 | -6.3 |
| 860 | -7.4 | -6.1 | -5.6 | -5.7 | -5.8 | -6.2 |
| 870 | -7.9 | -6.2 | -5.7 | -5.7 | -5.8 | -6.4 |
| 880 | -8.0 | -6.4 | -5.9 | -6.0 | -5.9 | -6.5 |
| 890 | -7.2 | -6.2 | -5.7 | -5.8 | -5.8 | -6.3 |
| 900 | -6.7 | -6.0 | -5.6 | -5.7 | -5.5 | -5.9 |
| 910 | -5.9 | -6.1 | -5.8 | -5.9 | -5.7 | -6.1 |
| 920 | -6.5 | -5.8 | -5.4 | -5.6 | -5.5 | -5.9 |
| 930 | -6.6 | -5.6 | -5.2 | -5.3 | -5.3 | -5.7 |
| 940 | -7.1 | -6.0 | -5.6 | -5.5 | -5.6 | -5.9 |
| 950 | -7.2 | -6.4 | -6.1 | -5.8 | -5.8 | -5.9 |
| 960 | -7.6 | -6.9 | -6.2 | -6.3 | -6.2 | -6.2 |
| 970 | -7.3 | -6.7 | -6.3 | -6.2 | -6.1 | -6.1 |
| AVERAGE GAIN (dB) | -7.0 | -6.2 | -5.8 | -6.0 | -5.9 | -6.4 |

FIG.40

| FREQUENCY (MHz) | LOCATION A1 | LOCATION A2 | REAR POLE ANTENNA | CONVENTIONAL WINDOW GLASS ANTENNA |
|---|---|---|---|---|
| 790 | -5.8 | -4.8 | -4.2 | -6.3 |
| 800 | -6.1 | -5.6 | -4.3 | -6.3 |
| 810 | -6.4 | -6.3 | -3.9 | -6.0 |
| 820 | -6.8 | -6.5 | -4.1 | -5.9 |
| 830 | -6.2 | -5.8 | -3.8 | -6.0 |
| 840 | -6.0 | -5.6 | -3.7 | -6.1 |
| 850 | -5.8 | -5.6 | -3.6 | -6.0 |
| 860 | -5.9 | -5.6 | -3.7 | -5.9 |
| 870 | -5.5 | -5.7 | -3.6 | -5.8 |
| 880 | -5.4 | -5.9 | -3.9 | -5.7 |
| 890 | -5.8 | -5.7 | -4.3 | -5.9 |
| 900 | -5.9 | -5.6 | -4.1 | -5.9 |
| 910 | -5.9 | -5.8 | -4.5 | -6.4 |
| 920 | -5.9 | -5.4 | -4.5 | -6.5 |
| 930 | -5.9 | -5.2 | -4.3 | -6.4 |
| 940 | -6.0 | -5.6 | -4.6 | -6.4 |
| 950 | -6.1 | -6.1 | -4.4 | -6.5 |
| 960 | -6.7 | -6.2 | -4.4 | -6.8 |
| 970 | -6.6 | -6.3 | -4.9 | -7.2 |
| AVERAGE GAIN (dB) | -6.0 | -5.8 | -4.1 | -6.2 |

800MHZ
850MHZ
900MHZ
950MHZ
LOCATION A

800MHZ
850MHZ
900MHZ
950MHZ
LOCATION B

800MHZ
850MHZ
900MHZ
950MHZ
CONVENTIONAL WINDOW GLASS PATTERN
REFERENCE GAIN 0dB : DIPOLE ANTENNA

WINDOW GLASS ANTENNA FOR MOTOR VEHICLES

This is a continuation of application Ser. No. 08/013,699, filed Feb. 4, 1993 now abandoned.

BACKGROUND OF THE INVENTION

1. Field of the Invention

The present invention relates to a window glass antenna to be attached to an automobile window glass panel for transmitting and receiving signals, such as mobile telephone signals, in an UHF band.

2. Description of the Prior Art

One conventional double-loop window glass antenna for use on an automobile window glass panel, for example, for transmitting and receiving signals, such as mobile telephone signals, in an UHF band, as disclosed in Japanese laid-open patent publication No. 4-14304 is shown in FIG. 1 of the accompanying drawings.

As shown in FIG. 1, the conventional double-loop window glass antenna, generally designated by the reference numeral 101, comprises two semicircular loop conductors 103*a*, 103*b*, two reactive conductors 104*a*, 104*b* connected respectively to the semicircular loop conductors 103*a*, 103*b*, and a ground conductor 105 connected to the reactive conductors 104*a*, 104*b*. These conductors 103*a*, 103*b*, 104*a*, 104*b*, 105 are mounted on a front or rear automobile window glass panel 102. The reactive conductors 104*a*, 104*b* are of an L shape interconnecting the ends of the semicircular loop conductors 103*a*, 103*b* and the ground conductor 105.

The junction between the semicircular loop conductors 103*a*, 103*b* is connected as a feed point 106 to the core 107*a* of a feed cable 107 whose outer conductor 107*b* is connected to the ground conductor 105. The double-loop window glass antenna 101 is thus supplied with electric energy from the feed cable 107 in an unbalanced configuration.

The conventional double-loop window glass antenna 101 is disadvantageous in that the antenna gain is lowered as the angle at which the window glass panel 102 is mounted on an automobile body, i.e., the angle between the horizontal plane and the window glass panel, is reduced. This is because the directivity pattern in a vertical plane of the double-loop window glass antenna 101 is relatively narrow. Therefore, the conventional double-loop window glass antenna 101 fails to provide sufficient antenna performance on those automobiles which have a front or rear glass panel inclined through a small angle for less aerodynamic resistance or design considerations.

Wide antenna patterns disposed on window glass panel surfaces or between laminated window glass layers for sufficient antenna performance are problematic for the following reasons:

Window glass panels for use on automobiles are bent into curved configurations to match automobile window frames. In a bending process, a flat window glass panel is placed on a mold, supplied into a heating furnace, and then bent while being heated up to a certain temperature. If such a flat window glass panel carries a wide antenna pattern and electrodes, the glass panel regions corresponding to the wide antenna pattern and electrodes have different temperatures than the other glass panel regions, with the results that the window glass panel may not be fully bent or may suffer local deformations. Therefore, window glass panels with wide antenna patterns may not be bent to a desired curved shape, or may produce distorted image reflections in local regions.

SUMMARY OF THE INVENTION

It is an object of the present invention to provide a window glass antenna whose antenna gain is not substantially lowered even when the window glass antenna is mounted on a window glass panel that is inclined at a small angle.

Another object of the present invention is to provide a window glass antenna that can easily be connected to ground for preventing an antenna gain from being reduced.

Still another object of the present invention is to provide a window glass antenna having an antenna pattern of a shape that allows a window glass panel on which the window glass antenna is mounted to be bent easily.

Yet still another object of the present invention is to provide a window glass antenna which can easily be located on a side edge of a window glass panel.

According to the present invention, there is provided a window glass antenna for use on a window glass panel, comprising a radiating pattern adapted to be mounted on the window glass panel and having a vertical length substantially equal to a quarter wavelength, and a ground pattern adapted to be mounted on the window glass panel in spaced relationship to the radiating pattern and having a vertical length substantially equal to a quarter wavelength and a horizontal width ranging from a half wavelength to a three-quarter wavelength.

According to the present invention, there is also provided a window glass antenna device for use on a window glass panel supported on a ground frame, comprising a radiating pattern adapted to be mounted on the window glass panel and having a vertical length substantially equal to a quarter wavelength, a ground pattern adapted to be mounted on the window glass panel in spaced relationship to the radiating pattern and having a vertical length substantially equal to a quarter wavelength and a horizontal width ranging from a half wavelength to a three-quarter wavelength, and a ground conductor for electrically connecting the ground pattern to the ground frame.

According to the present invention, there is further provided a window glass antenna for use on a window glass panel, comprising a vertically elongate radiating pattern adapted to be mounted on the window glass panel, and a horizontally elongate ground pattern adapted to be mounted on the window glass panel in downwardly spaced relationship to the vertically elongate radiating pattern.

According to the present invention, there is further provided a window glass antenna for use on a window glass panel, comprising a radiating pattern adapted to be mounted on the window glass panel and having a vertical length substantially equal to a quarter wavelength, and a ground pattern adapted to be mounted on the window glass panel in spaced relationship to the radiating pattern and having a horizontal width substantially equal to a quarter wavelength, the ground pattern being of a centrally open shape, the radiating and ground patterns being adapted to be positioned near one vertical edge of the window glass panel.

The above and further objects, details and advantages of the present invention will become apparent from the following detailed description of preferred embodiments thereof, when read in conjunction with the accompanying drawings.

BRIEF DESCRIPTION OF THE DRAWINGS

FIG. 20(*b*) is an enlarged fragmentary elevational view of the window glass antenna device shown in FIG. 20(*a*);

FIG. 38 is a table showing the relationship between the ground pattern width and the average gain;

FIG. 40 a table showing the average gains of the various antennas;

DETAILED DESCRIPTION OF THE PREFERRED EMBODIMENTS

Figure 1:
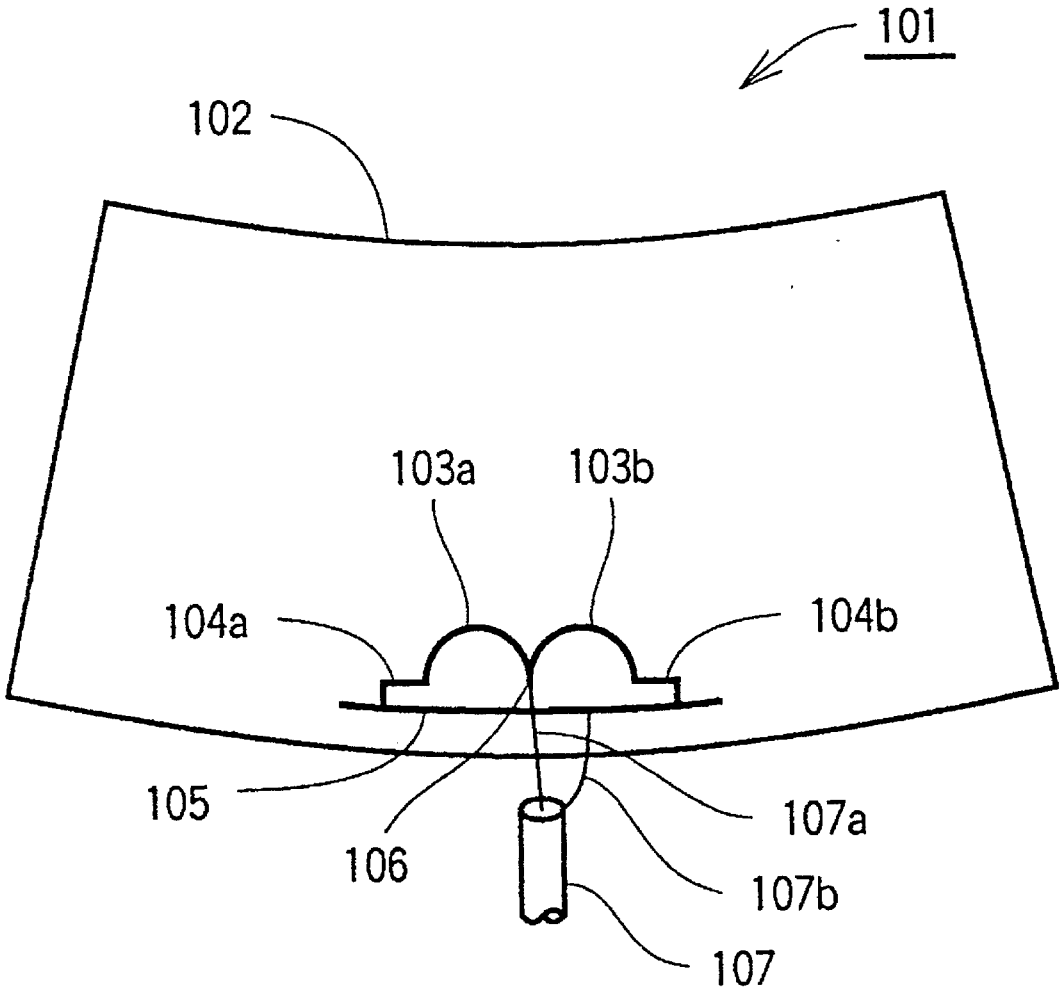
FIG. 1 PRIOR ART
FIG. 1 is a front elevational view of a conventional double-loop window glass antenna for use in an UHF band.

Like or corresponding parts are denoted by like or corresponding reference characters throughout views.

Figure 2:
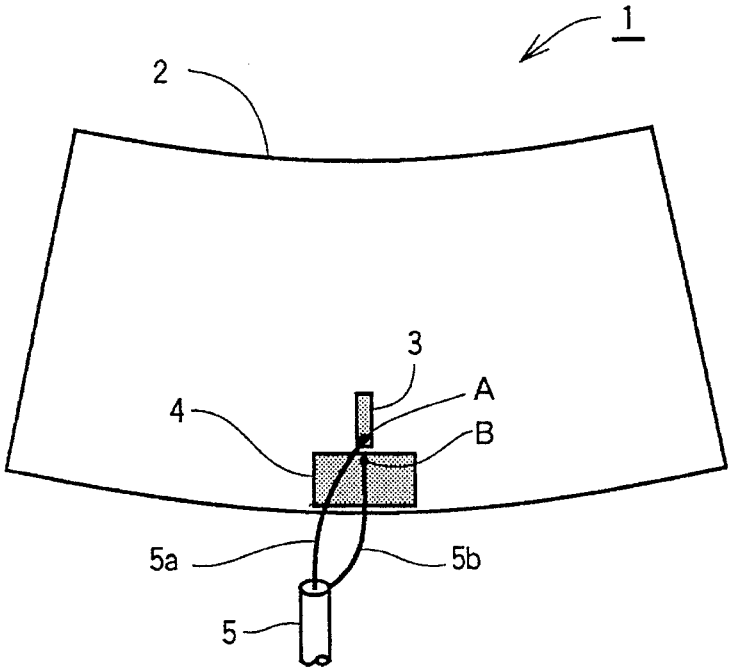
FIG. 2 is a front elevational view of a window glass antenna according to a first embodiment of the present invention.

FIG. 2 shows a window glass antenna according to a first embodiment of the present invention, for transmitting and receiving signals, such as mobile telephone signals, in an UHF band, for example.

The window glass antenna, generally designated by the reference numeral 1, comprises a radiating pattern 3 of electrically conductive material and a ground pattern 4 of electrically conductive material which are mounted on a window glass panel 2 such as an automobile window glass panel. The radiating pattern 3 comprises a vertically elongate strip, and the ground pattern 4 comprises a horizontally elongate, solid rectangular plate. The radiating pattern 3 is spaced from and positioned on one side, i.e., upwardly, of the ground pattern 4, which is positioned near a lower edge of the window glass panel 2. The radiating pattern 3 has a vertical longitudinal axis extending perpendicular to the horizontal longitudinal axis of the ground pattern 4. A coaxial cable 5 has a core 5*a* connected to the radiating pattern 3, and an outer conductor 5*b* connected to the ground pattern 4. Specifically, the core 5*a* is connected to a feed point A at the lower end of the radiating pattern 3, and the outer conductor 5*b* is connected to a ground point B at the upper edge of the ground pattern 4 near the lower end of the radiating pattern 3.

The coaxial cable 5 is shown as relatively spaced from the radiating and ground patterns 3, 4 in FIG. 2. Actually, however, the core 5*a* and the outer conductor 5*b* that are exposed and connected to connection terminals, or the feed and ground points A, B, of the radiating and ground patterns 3, 4 have a minimum length which may be 5 mm or less for transmitting and receiving signals in a frequency band of about 800 MHz, for example.

Figure 3:
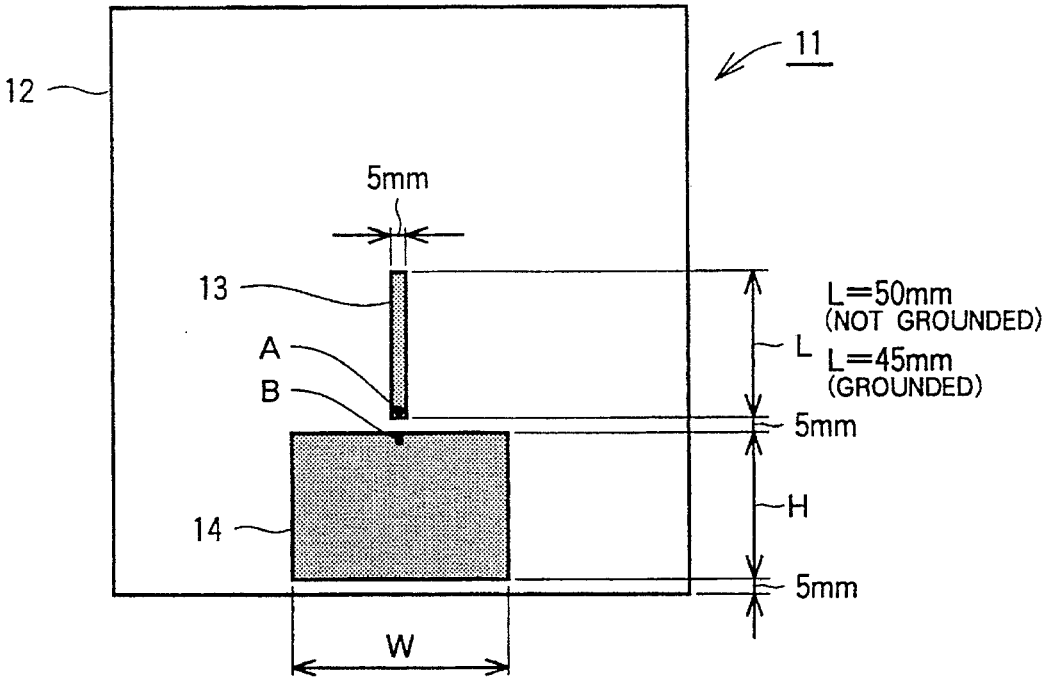
FIG. 3 is a front elevational view of an evaluating antenna.

FIG. 3 shows an evaluating antenna which was used to evaluate the window glass antenna 1 shown in FIG. 2.

As shown in FIG. 3, the evaluating antenna, generally denoted at 11, comprised a vertically elongate strip-shaped radiating pattern 13 and a horizontally elongate rectangular-shape ground pattern 14 which were mounted on a flat glass sheet 12 whose area was wide enough to support necessary antenna patterns.

The evaluating antenna 11 was designed as an antenna for transmitting and receiving automobile telephone signals in a frequency band of about 800 MHz. The radiating pattern 13 had a width (horizontal dimension) of 5 mm and a length (vertical dimension) L ranging from 45 mm (grounded to an automobile body) to 50 mm (not grounded to the automobile body). The ground pattern 14 had an upper horizontal edge vertically spaced from the lower end of the radiating pattern 13 by a distance of 5 mm. The ground pattern 14 had a length (vertical dimension) H and a width (horizontal dimension) W. The radiating and ground patterns 13, 14 were in the form of copper foils on one surface of the flat glass sheet 12, which had a thickness of 5 mm.

In evaluating the window glass antenna 1, various ground patterns of different dimensions were used. More specifically, the ground patterns that were used had lengths of 10, 30, 50 mm and widths W of 50, 100, 150, 200, 250, 300, 350 mm.

Figure 4:
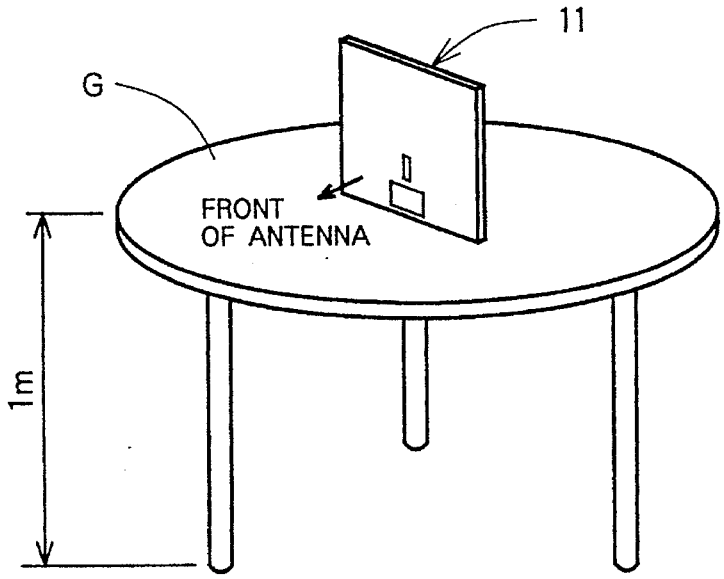
FIG. 4 is a perspective view of a simulating system for measuring antenna characteristics of the evaluating antenna.

FIG. 4 shows a simulating system for measuring antenna characteristics of the evaluating antenna 11.

The simulating system had a circular iron plate G spaced upwardly from the floor by a distance of 1 mm, and the evaluating antenna 11 is disposed at a predetermined angle on the iron plate G substantially at its center. The evaluating antenna 11 was connected to a measuring device (not shown) through a coaxial cable (not shown in FIG. 5) of type 2.5 D-2 V which has an impedance of 50 Ω. The coaxial cable was the same as the coaxial cable 5 shown in FIG. 2.

The core 5*a* of the coaxial cable 5 was connected to a feed point A (see FIG. 2) at the lower end of the radiating pattern 13, and the outer conductor 5*b* of the coaxial cable 5 was connected to a ground point B at the upper edge of the ground pattern 14 near the lower end of the radiating pattern 13. The coaxial cable 5 between the evaluating antenna 11 and the measuring device had a length of 2 m.

Figure 5:
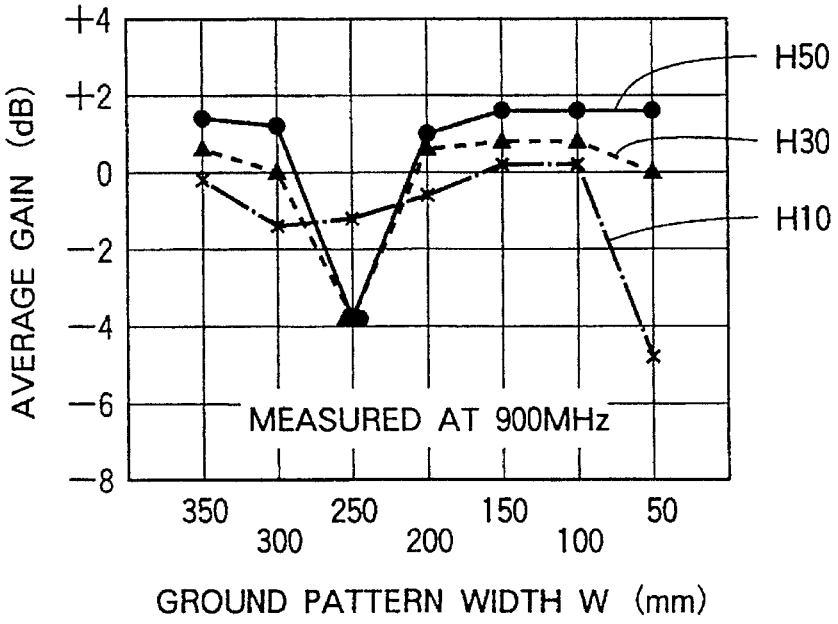
FIG. 5 is a graph showing the relationship between the length and width of the ground pattern of the evaluating antenna and the antenna gain thereof.

FIG. 5 shows the relationship between the length H and width W of the ground pattern 14 and the antenna gain of the evaluating antenna 11 as the antenna gain was measured using the simulating system shown in FIG. 4.

The graph of FIG. 5 has a horizontal axis representing the width W and a vertical axis representing the average gain. Characteristic curves H10, H30, H50 indicate the average gains of antennas whose ground patterns had lengths H of 10 mm, 30 mm, 50 mm, respectively. The average gains were measured at a frequency of 900 MHz.

The average gain represents the ratio of the gain of the evaluating antenna to the gain of a standard dipole antenna.

Figure 6:
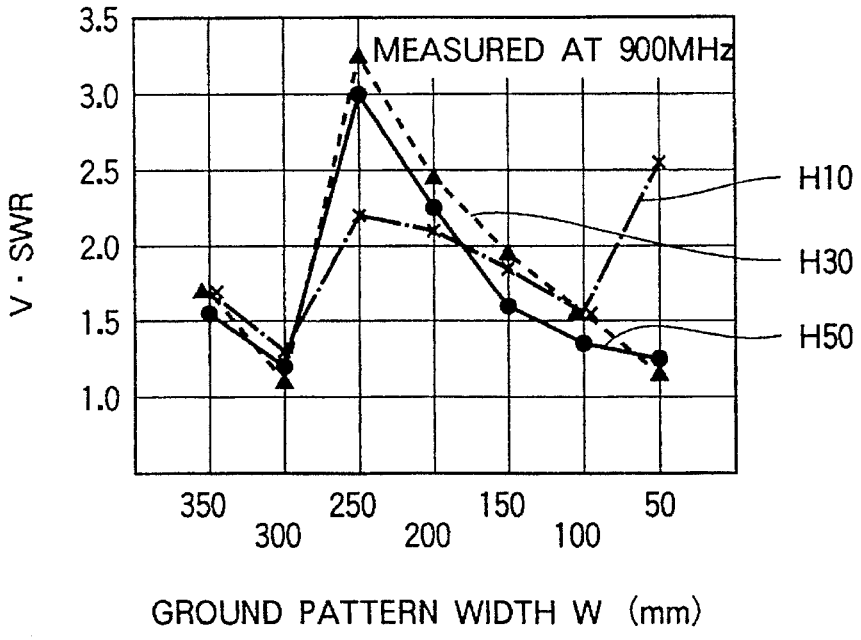
FIG. 6 is a graph showing the relationship between the length and width of the ground pattern evaluating antenna and the voltage vs. standing wave ratio thereof.

FIG. 6 shows the relationship between the length L and width W of the ground pattern 14 of the evaluating antenna 11 and the voltage vs. standing wave ratio thereof. The graph of FIG. 6 has a horizontal axis representing the width W and a vertical axis representing the voltage vs. standing wave ratio V.SWR. Characteristic curves H10, H30, H50 indicate the voltage vs. standing wave ratios V.SWR of antennas whose ground patterns had lengths H of 10 mm, 30 mm, 50 mm, respectively. The voltage vs. standing wave ratios V.SWR were measured at a frequency of 900 MHz.

It can be seen from FIGS. 5 and 6 that when the length L of the radiating pattern 13 was 50 mm (45 mm if grounded to the automobile body) taking an antenna shrinkage factor into account, the width W of the ground pattern 14 ranged from 100 to 150 mm, and the length H of the ground pattern 14 was 50 mm, both the average gain which indicates the reception performance of the antenna and the voltage vs. standing wave ratio which indicates the transmission performance of the antenna were improved.

If the shrinkage factor of the antenna on the window glass panel is about 0.6, then a quarter wavelength at the frequency of 900 MHz is about 50 mm. Therefore, when the length L of the radiating pattern 3 is a quarter wavelength, the length H of the ground pattern 4 is a quarter wavelength, and the width W of the ground pattern 4 is in the range of from a half wavelength to three-quarter wavelength, the antenna has good antenna characteristics for both signal transmission and reception.

Figure 7:
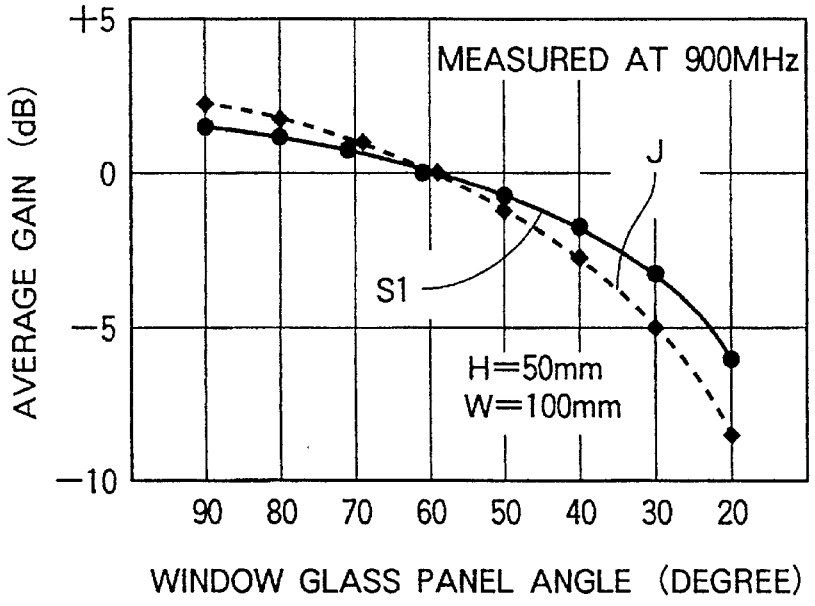
FIG. 7 is a graph showing the relationship between the angle of a window glass panel for supporting the window glass antenna according to the first embodiment and the conventional window glass antenna shown in FIG. 1, and the average antenna gain of the window glass antenna and the conventional window glass antenna.

FIG. 7 shows the relationship between the angle of the window glass panel 2 for supporting the window glass antenna 1 according to the first embodiment and the conventional window glass antenna 101 shown in FIG. 1, and the average antenna gain of the window glass antenna 1 and the conventional window glass antenna. The angle of the window glass panel is represented by the angle between the horizontal plane and the window glass panel.

The graph of FIG. 7 has a horizontal axis representing the angle at which the window glass panels are mounted on the automobile body, and a vertical axis representing the average gain. A solid-line curve S1 indicates antenna characteristics of the window glass antenna 1, and a dotted-line curve J indicates antenna characteristics of the conventional window glass antenna 101.

The dimensions of the patterns of the window glass antenna 1 that was measured are as follows:

Radiating pattern: Width=5 mm, Length L=50 mm

Ground pattern: Width W=100 mm, Length H=50 mm

Spacing between the radiating and ground patterns=5 mm

When the angle of the window glass panel is in excess of 60°, the gain of the conventional window glass antenna 101 was greater than the gain of the window glass antenna 1. However, when the angle of the window glass panel is smaller than 60°, the gain of the window glass antenna was greater than the gain of the conventional window glass antenna 101, i.e., drops to a smaller extent than the gain of the conventional window glass antenna 101.

Figure 8:
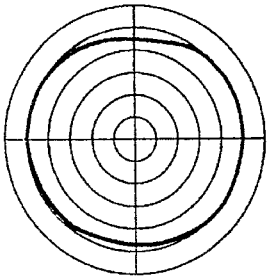
FIGS. 8(*a*) through 8(*i*) are diagrams illustrative of directivity patterns in a horizontal plane of the window glass antenna according to the first embodiment.
Figure 8:
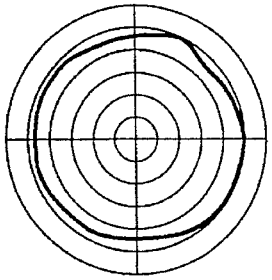
Figure 8:
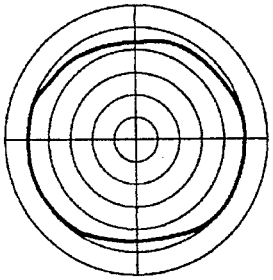
Figure 8:
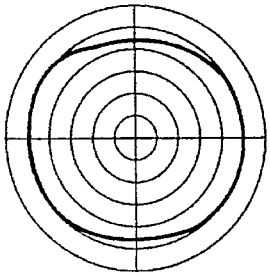
Figure 8:
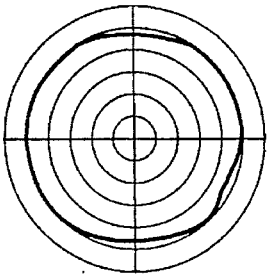
Figure 8:
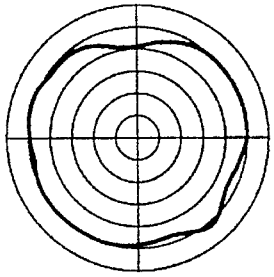
Figure 8:
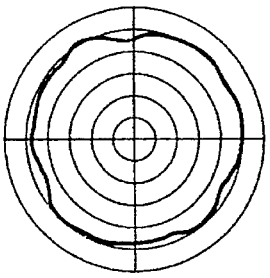
Figure 8:
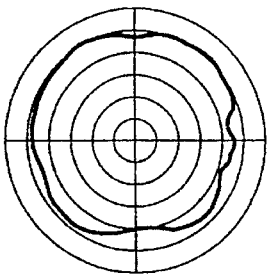
Figure 8:
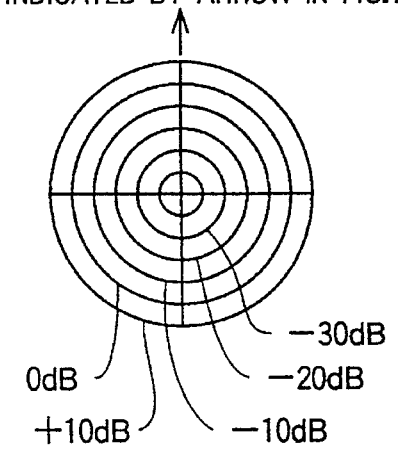

FIGS. 8(*a*) through 8(*i*) are illustrative of directivity patterns in a horizontal plane of the window glass antenna 1 according to the first embodiment at different frequencies, the directivity patterns being measured using the simulating system shown in FIG. 4. The pattern dimensions of the window glass antenna 1 were the same as those described above. FIG. 8(*i*) shows the direction and gains of each graph of FIGS. 8(*a*) through 8(*h*). The gains of the window glass antenna 1 were measured when the window glass panel with the window glass antenna 1 was vertically oriented, i.e., when the angle thereof was 90°, on the iron plate G. Study of FIGS. 8(*a*) through 8(*h*) indicates that the window glass antenna 1 has substantially good nondirectional characteristics.

Figure 9:
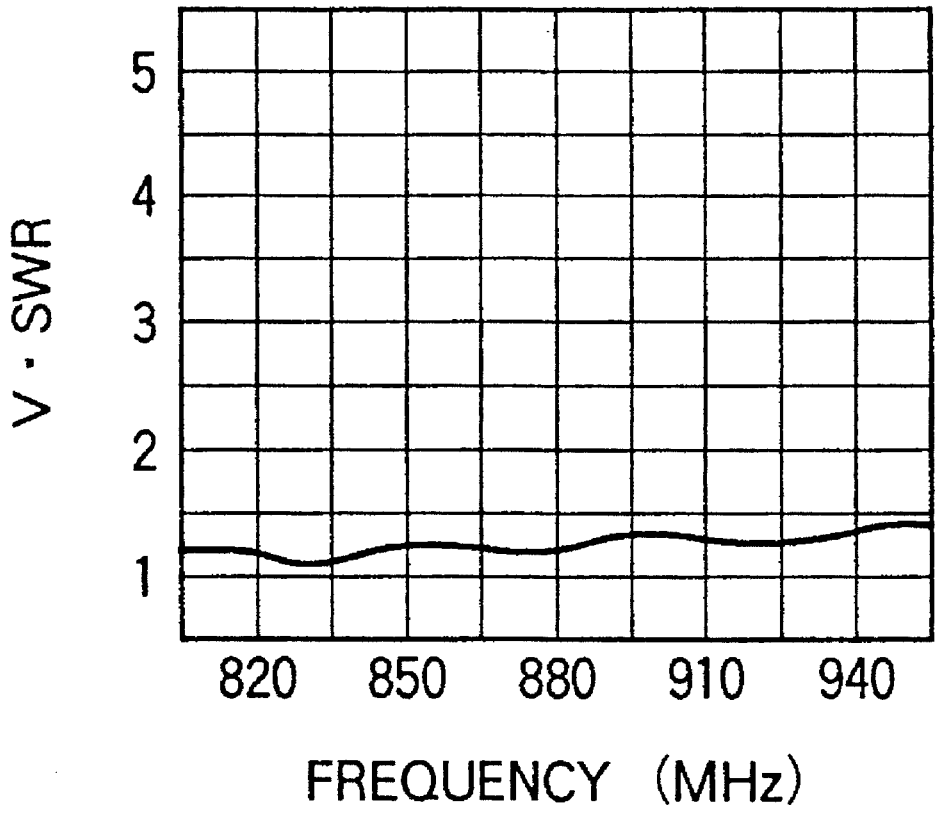
FIG. 9 is a graph showing the frequency characteristics of the voltage vs. standing wave ratio of the window glass antenna according to the first embodiment.

FIG. 9 shows the frequency characteristics of the voltage vs. standing wave ratio (V.SWR) of the window glass antenna 1 according to the first embodiment. As can be seen from FIG. 9, the voltage vs. standing wave ratio (V.SWR) of the window glass antenna 1 is lens than 1.5, indicating that the window glass antenna 1 has practically sufficient V.SWR characteristics.

Figure 10:
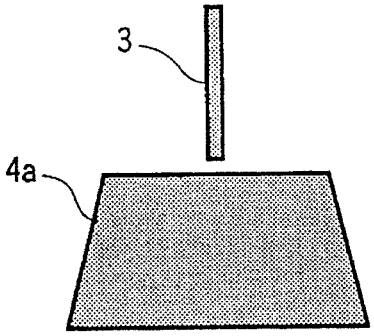
FIGS. 10(*a*) through 10(*h*) are elevational views of modified antenna patterns.
Figure 10:
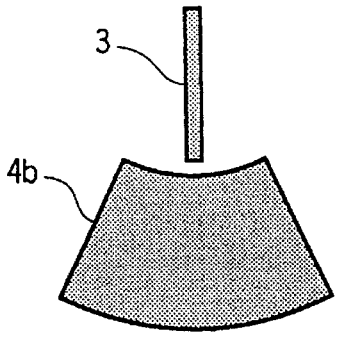
Figure 10:
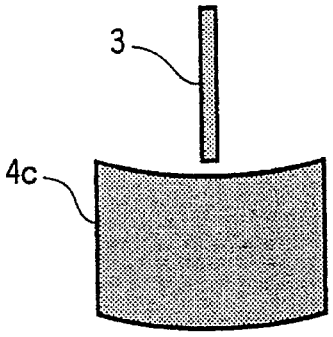
Figure 10:
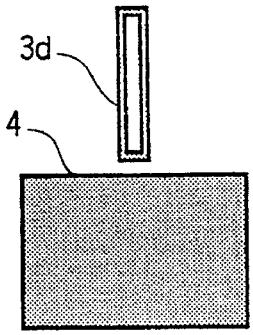
Figure 10:
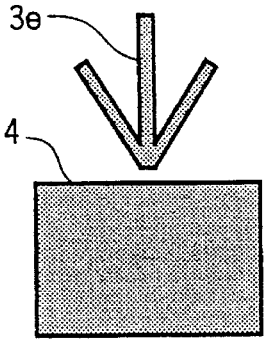
Figure 10:
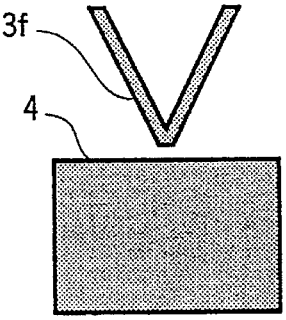
Figure 10:
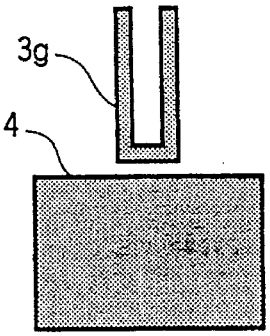
Figure 10:
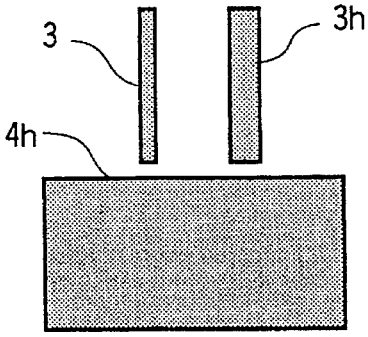

FIGS. 10(*a*) through 10(*h*) illustrate modified antenna patterns.

In FIG. 10(*a*), the radiating pattern 3 is combined with a ground pattern 4*a* that is of a trapezoidal shape. In FIG. 10(*b*), the radiating pattern 3 is combined with a ground pattern 4*b* that is of a sectorial shape. In FIG. 10(*c*), the radiating pattern 3 is combined with a ground pattern 4*c* that is of an arcuate shape. In FIG. 10(*d*), the ground pattern 4 is combined with a hollow, or centrally open, radiating pattern 3*d*. In FIG. 10(*e*), the ground pattern 4 is combined with an arrow-shaped radiating pattern 3*e*. In FIG. 10(*f*), the ground pattern 4 is combined with a V-shaped radiating pattern 3*f*. In FIG. 10(*g*), the ground pattern 4 is combined with a U-shaped radiating pattern 3*g*. In FIG. 10(*h*), another elongate radiating pattern 3*h* is disposed along and parallel to the radiating pattern 3, and they are combined with a common rectangular ground pattern 4*h*. The antenna patterns shown in FIG. 10(*h*) are suitable for use as a diversity reception system.

Figure 11:
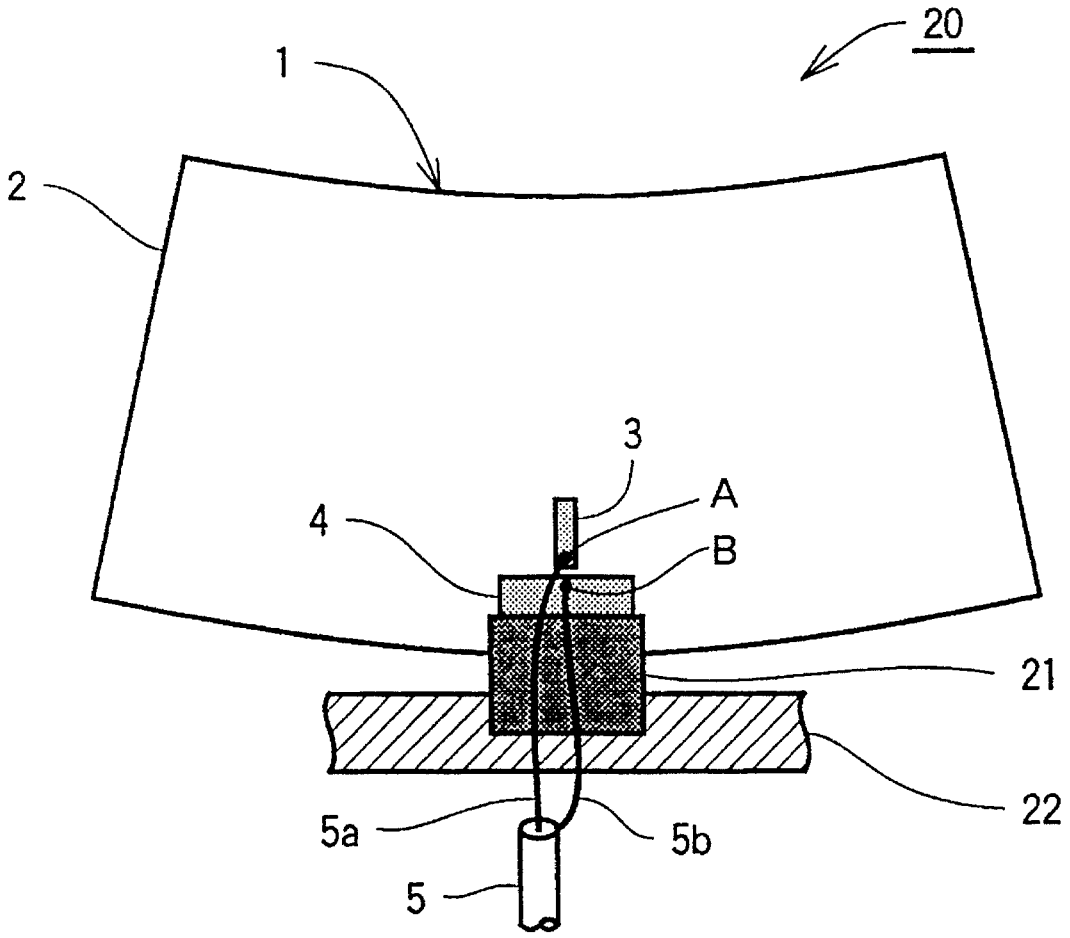
FIG. 11 is a front elevational view of a window glass antenna according to a second embodiment of the present invention.

FIG. 11 shows a window glass antenna according to a second embodiment of the present invention.

As shown in FIG. 11, the window glass antenna, generally denoted at 20, has a radiating pattern 3 and a ground pattern 4 which are identical to those shown in FIG. 2. The radiating pattern 3 and the ground pattern 4 are connected to a core 5*a* and an outer conductor 5*b* of a coaxial cable 5 as with the first embodiment. The ground pattern 4 is electrically connected to a metallic window frame 22 of the automobile by a low-impedance ground connector 21 which may comprise a wide copper foil or the like. The ground connector 21 may be connected to the metallic window frame 22 through a card-type female connector on the metallic window frame 22.

Figure 12:
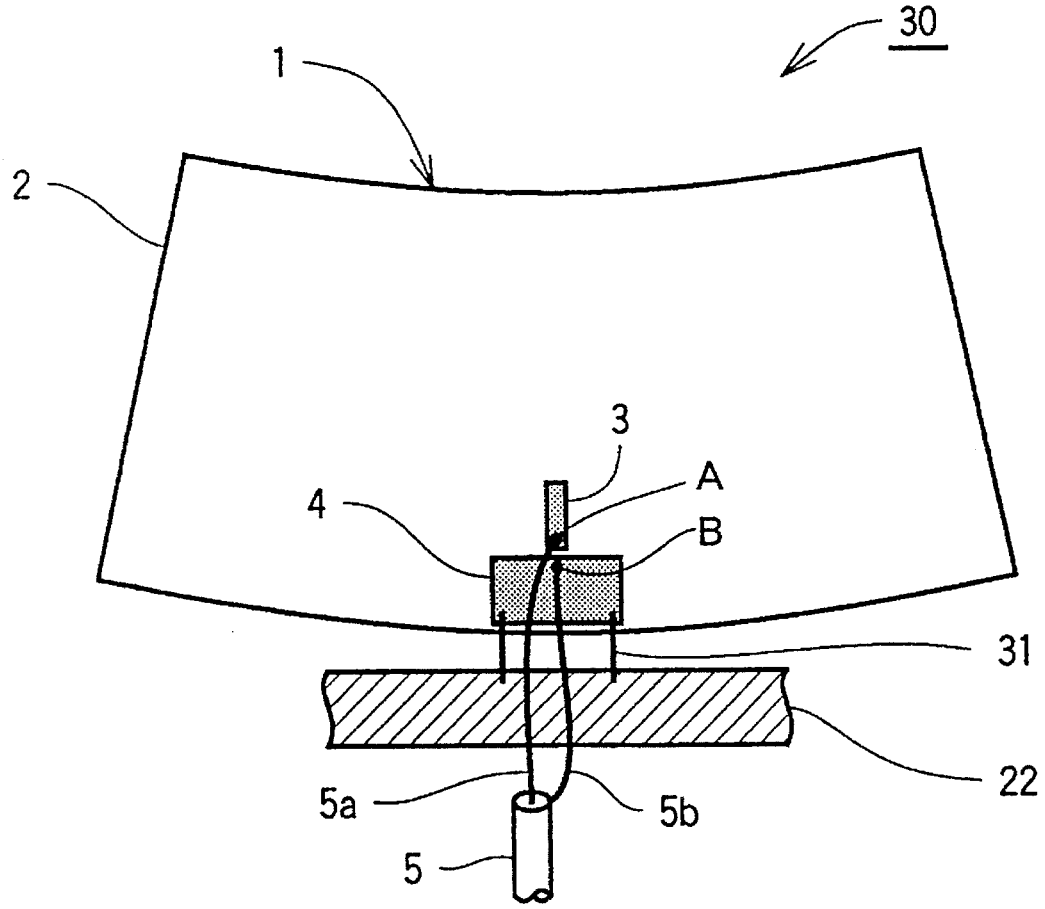
FIG. 12 is a front elevational view of a window glass antenna according to a third embodiment of the present invention.

FIG. 12 shows a window glass antenna according to a third embodiment of the present invention.

As shown in FIG. 12, the window glass antenna, generally denoted at 30, has a radiating pattern 3 and a ground pattern 4 which are identical to those shown in FIG. 2. The radiating pattern 3 and the ground pattern 4 are connected to a core 5*a* and an outer conductor 5*b* of a coaxial cable 5 as with the first embodiment. The ground pattern 4 is electrically connected at opposite ends thereof to a metallic window frame 22 of the automobile by two respective ground wires 31. The ground wires 31 may be connected to the metallic window frame 22 through pairs of male and female connectors without soldering. In the third embodiment, since the opposite ends of the ground pattern 4 are connected to ground, any change in the antenna gain caused when the angle of the window glass panel 2 is varied is minimized.

In FIGS. 11 and 12, the outer conductor 5*b* may be connected to the automobile body such as the metallic window frame 22.

The window glass antennas 20, 30 were evaluated using the evaluating antenna 11 shown in FIG. 3 in the simulating system shown in FIG. 4 where the ground pattern 14 was electrically connected to the iron plate G.

Figure 13:
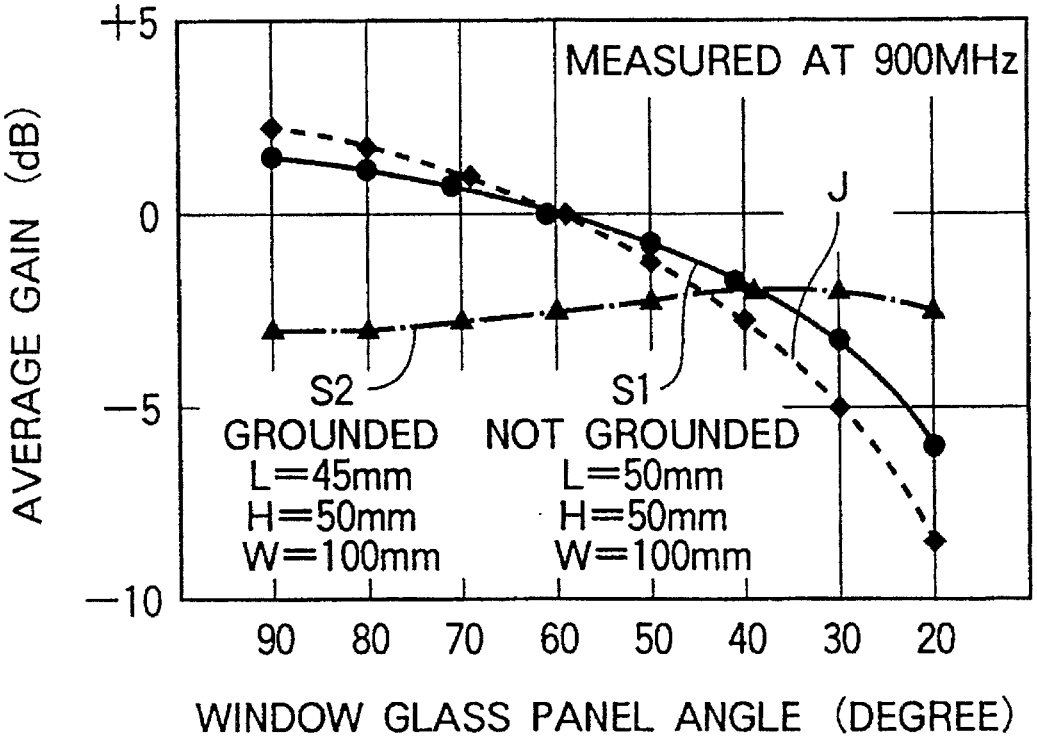
FIG. 13 is a graph showing the relationship between the angle of the window glass panel for supporting window glass antennas and the average antenna gain of the window glass antennas, the view illustrating the results of the evaluation of the window glass antennas according to the second and third embodiments.

FIG. 13 shows the relationship between the angle of the window glass panel for supporting window glass antennas and the average antenna gain of the window glass antennas, the view illustrating the results of the evaluation of the window glass antennas 20, 30.

In the graph of FIG. 13, a solid-line curve S1 indicates antenna characteristics of the window glass antenna, and a dotted-line curve J indicates antenna characteristics of the conventional window glass antenna 101. A dot-and-dash-line characteristic curve S2 indicates antenna characteristics of the evaluating antenna 11 whose ground pattern 14 was grounded to the iron plate G equivalent to the automobile body.

Review of FIG. 13 shows that with the ground pattern 14 being grounded to the automobile body, the antenna sensitivity only varies to a small extent when the angle of the window glass panel is varied. When the angle of the window glass panel is smaller than about 40°, the sensitivity of the grounded window glass antenna is higher than the conventional window glass antenna.

Figure 14:
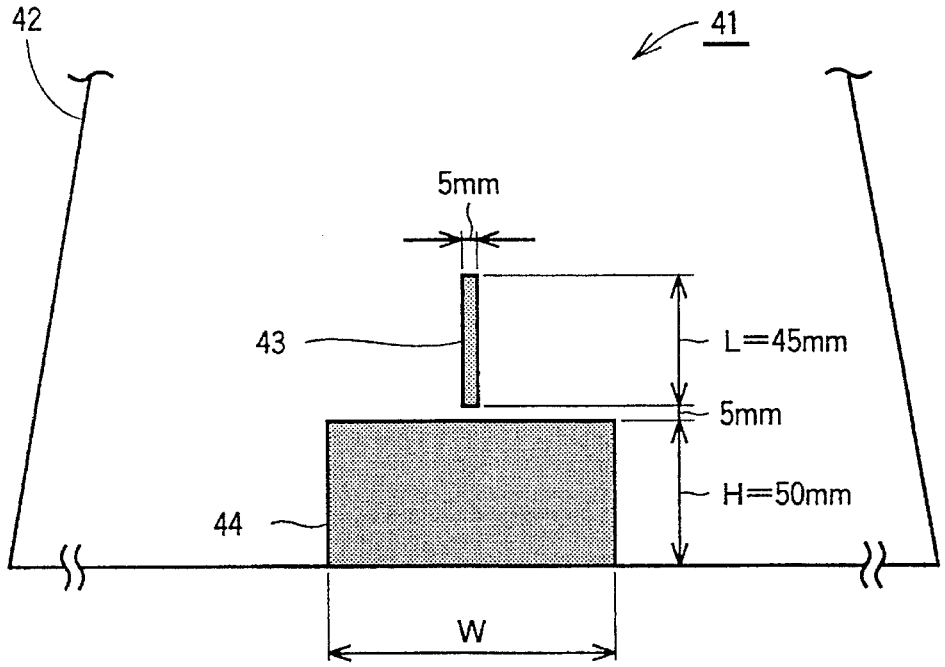
FIG. 14 is a front elevational view of a window glass antenna to be actually mounted on an automobile.

FIG. 14 shows a window glass antenna to be actually mounted on an automobile, the window glass antenna being grounded to the automobile body. In FIG. 14, the window glass antenna, generally denoted at 41, comprises a radiating pattern 43 and a ground pattern 44 which are mounted on an automobile window glass panel 42. The ground pattern 44 has a lower edge substantially aligned with the lower edge of the window glass panel 42, so that the ground pattern 44 can easily be grounded, i.e., connected to an automobile window frame. The radiating pattern 43 has a width of 5 mm and a length L of 45 mm, and the ground pattern 44 has a width W of 150 mm and a length H of 50 mm.

Figure 15:
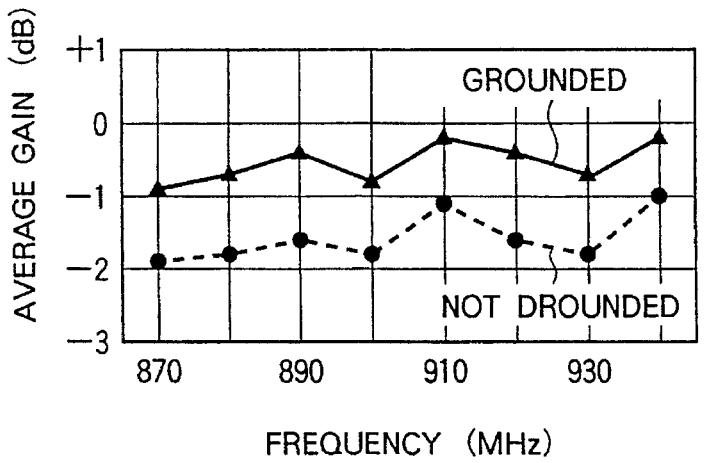
FIG. 15 is a graph showing the frequency characteristics of the antenna gain of the window glass antenna shown in FIG. 14.

FIG. 15 shows the frequency characteristics of the antenna gain of the window glass antenna 41 as it is mounted on the automobile at an angle of 32°.

The graph of FIG. 15 has a vertical axis representing the average gain of the window glass antenna, the gain 0 (dB) being equal to the gain of a standard dipole antenna, and a horizontal axis representing the frequency. A solid-line characteristic curve indicates the frequency characteristics of the antenna gain of the window glass antenna when it was grounded to the automobile body, and a dotted-line characteristic curve indicates the frequency characteristics of the antenna gain of the window glass antenna when it was not grounded to the automobile body. It can be seen from FIG. 15 that the average gain increased by about 1 dB when the ground pattern was grounded to the automobile body.

Figure 16:
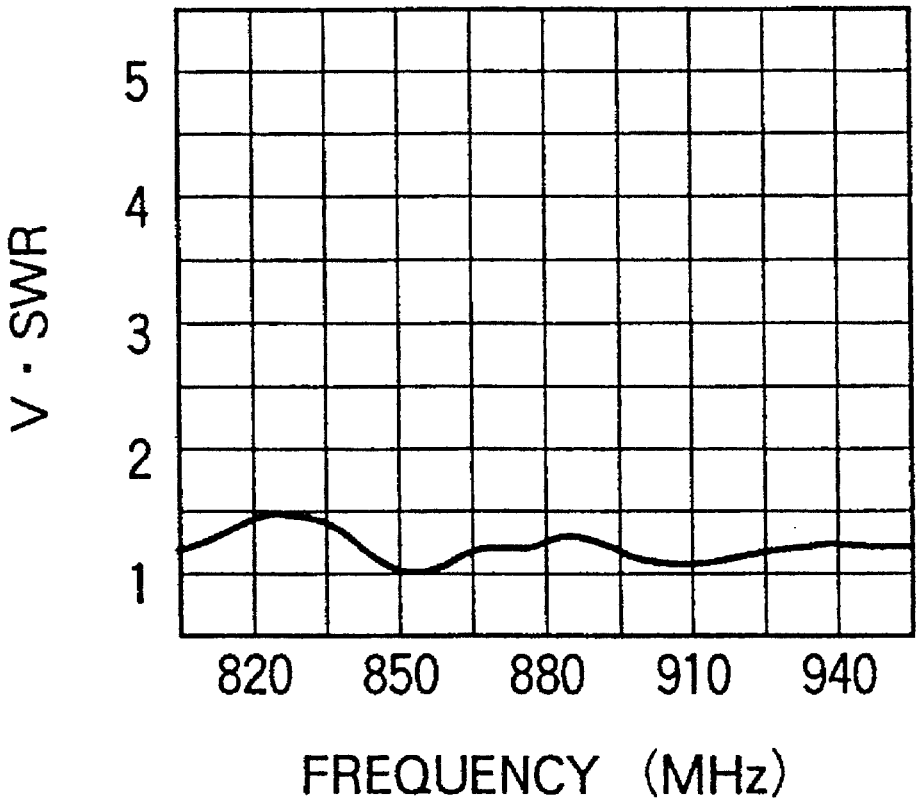
FIG. 16 is a graph showing the frequency characteristics of the voltage vs. standing wave ratio of the window glass antenna shown in FIG. 14.

FIG. 16 shows the frequency characteristics of the voltage vs. standing wave ratio (V.SWR) of the window glass antenna 41 which is mounted on the automobile at the angle of 32° and grounded to the automobile body. As can be seen from FIG. 16, the voltage vs. standing wave ratio (V.SWR) of the window glass antenna 41 is lens than 1.5, and hence is of a practical level.

Figure 17:
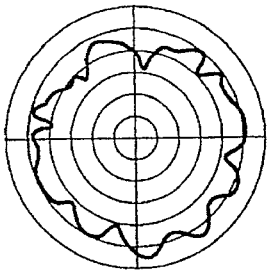
FIGS. 17(*a*) through 17(*i*) are diagrams illustrative of directivity patterns in a horizontal plane of the window glass antenna shown in FIG. 14.
Figure 17:
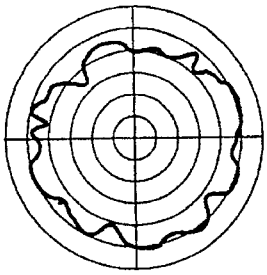
Figure 17:
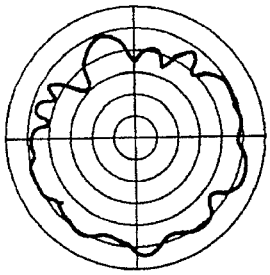
Figure 17:
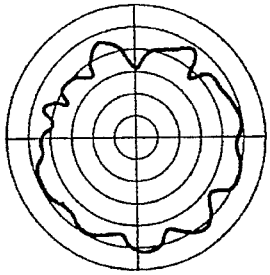
Figure 17:
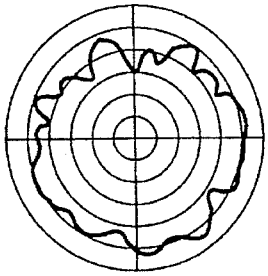
Figure 17:
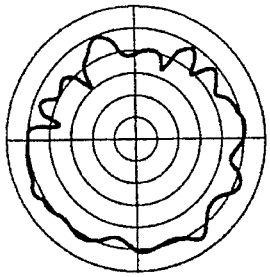
Figure 17:
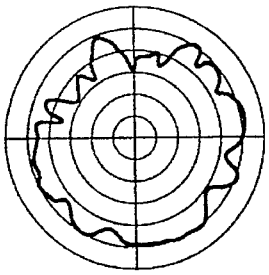
Figure 17:
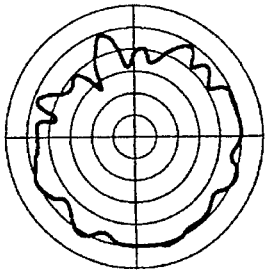
Figure 17:
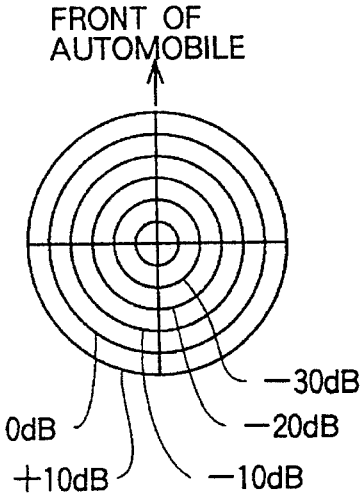

FIGS. 17(*a*) through 17(*i*) show directivity patterns in a horizontal plane of the window glass antenna 41 at different frequencies. FIG. 17(*i*) shows the direction and gains of each graph of FIGS. 17(*a*) through 17(*h*). The gains of the window glass antenna 41 were measured when the angle of the window glass antenna was 32°. The directivity patterns shown in FIGS. 17(*a*) through 17(*h*) suffer plural dips which are however in a practically allowable range.

Figure 18:
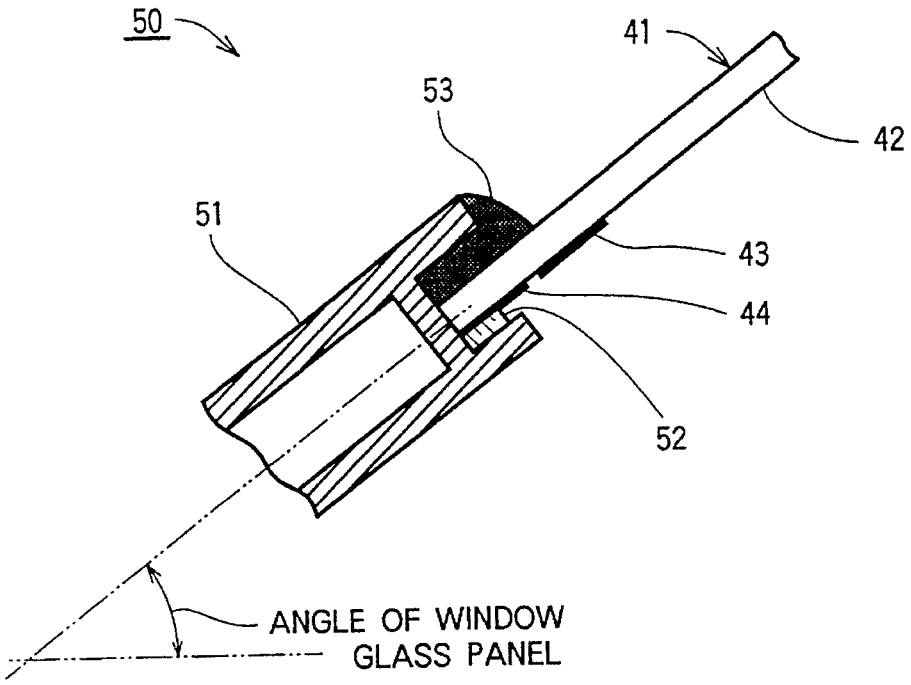
FIG. 18 is an enlarged fragmentary cross-sectional view of a window glass antenna device according to a fourth embodiment of the present invention.

FIG. 18 shows a window glass antenna device according to a fourth embodiment of the present invention. As shown in FIG. 18, the window glass antenna device, generally denoted at 50, comprises the window glass antenna 41 shown in FIG. 14. The ground pattern 44 which is mounted on the automobile window glass panel 42 is held against a metallic window frame 51 through a flexible conductive layer 52 sandwiched laterally between the ground pattern 44 and a flange of the window frame 51 so that the ground pattern 44 is electrically connected to the window frame 51. A molded gasket 53 is interposed between the window frame 51 and the window glass antenna 41 on one side of the window glass antenna 41 opposite to the flexible conductive layer 52. The flexible conductive layer 52 may comprise a conductive rubber layer, a rubber layer containing thin metallic wires, or the like. Even if the ground pattern 44 is mounted on a curved surface of the window glass antenna 41, the flexible conductive layer 52 allows stable electric connection between the ground pattern 44 and the window frame 51 over a wide area.

Figure 19:
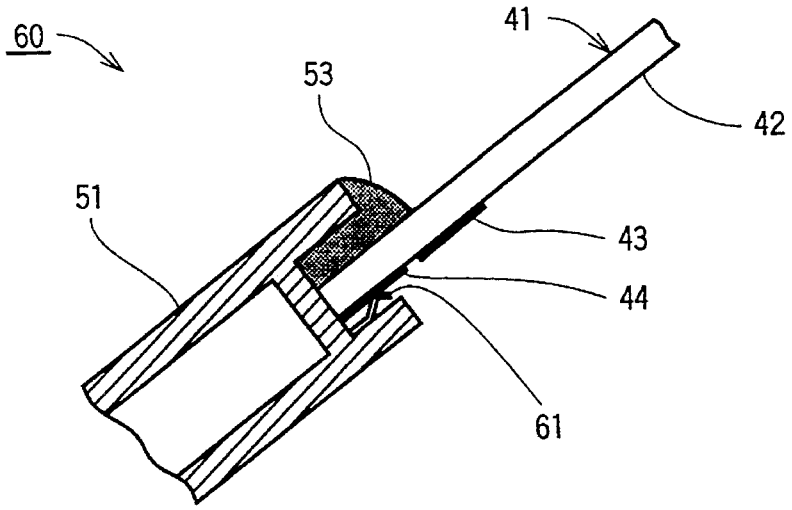
FIG. 19 is an enlarged fragmentary cross-sectional view of a window glass antenna device according to a fifth embodiment of the present invention.

FIG. 19 shows a window glass antenna device according to-a fifth embodiment of the present invention. As shown in FIG. 19, the window glass antenna device, generally denoted at 60, comprises the window glass antenna 41 shown in FIG. 14. The ground pattern 44 is held against a metallic window frame 51 through a flexible contact strip 61 sandwiched laterally between the ground pattern 44 and a flange of the window frame 51 so that the ground pattern 44 is electrically connected to the window frame 51. The contact strip 61 may comprise a springy conductive metallic member as of phosphor bronze or the like.

Figures 20A, 20B:
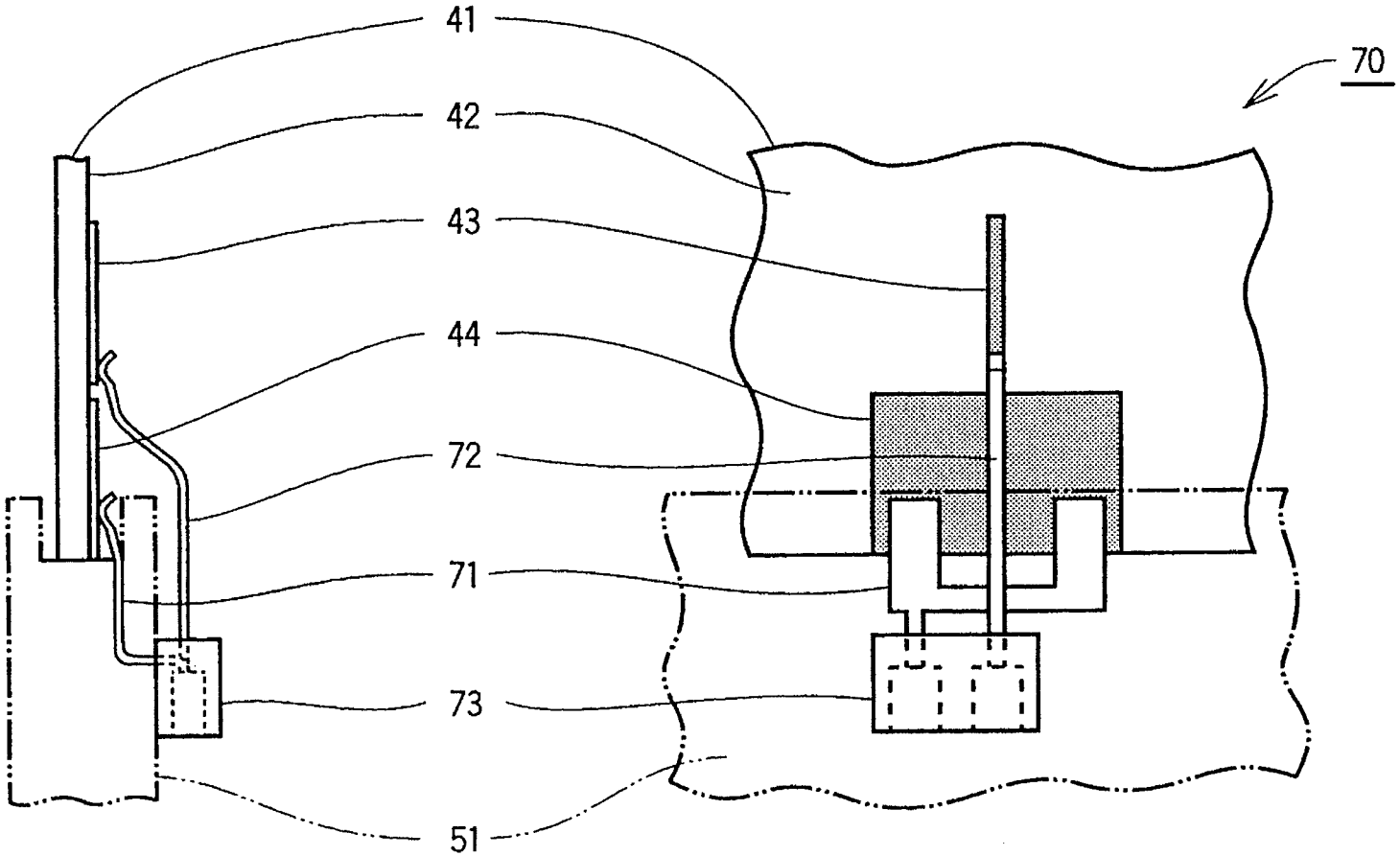
FIG. 20(*a*) is an enlarged fragmentary side elevational view of a window glass antenna device according to a sixth embodiment of the present invention.

A window glass antenna device according to a sixth embodiment of the present invention will be described below with reference to FIGS. 20(*a*) and 20(*b*). As shown in FIGS. 20(*a*) and 20(*b*), the window glass antenna device, generally denoted at 70, comprises the window glass antenna 41 shown in FIG. 14. The ground pattern 44 is electrically connected to the window frame 51 through a ground strip 71. The radiating pattern 43 is electrically connected to a feed connector 73 through a feed strip 72. Each of the strips 71, 72 may comprise a springy conductive metallic member as of phosphor bronze or the like.

Figure 21:
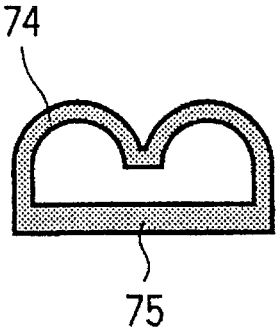
FIGS. 21(*a*) through 21(*c*) are front elevational views of modified window glass antennas with ground patterns that may be connected to ground.
Figure 21:
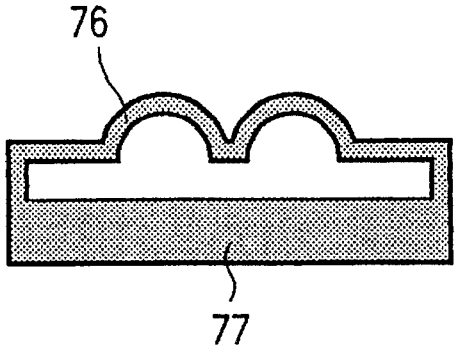
Figure 21:
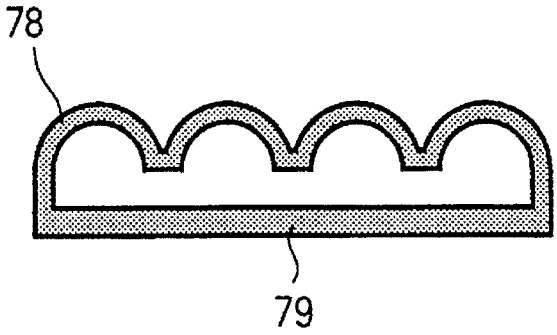

FIGS. 21(*a*) through 21(*c*) show modified window glass antennas with ground patterns that may be connected to ground.

The window glass antenna shown in FIG. 21(*a*) has a pair of semicircular loop conductors 74 connected to a ground pattern 75. The window glass antenna shown in FIG. 21(*b*) has a pair of semicircular loop conductors 76 connected to a longer ground pattern 77. The window glass antenna shown in FIG. 21(*c*) has four successive semicircular loop conductors 78 connected to a ground pattern 79.

Figure 22:
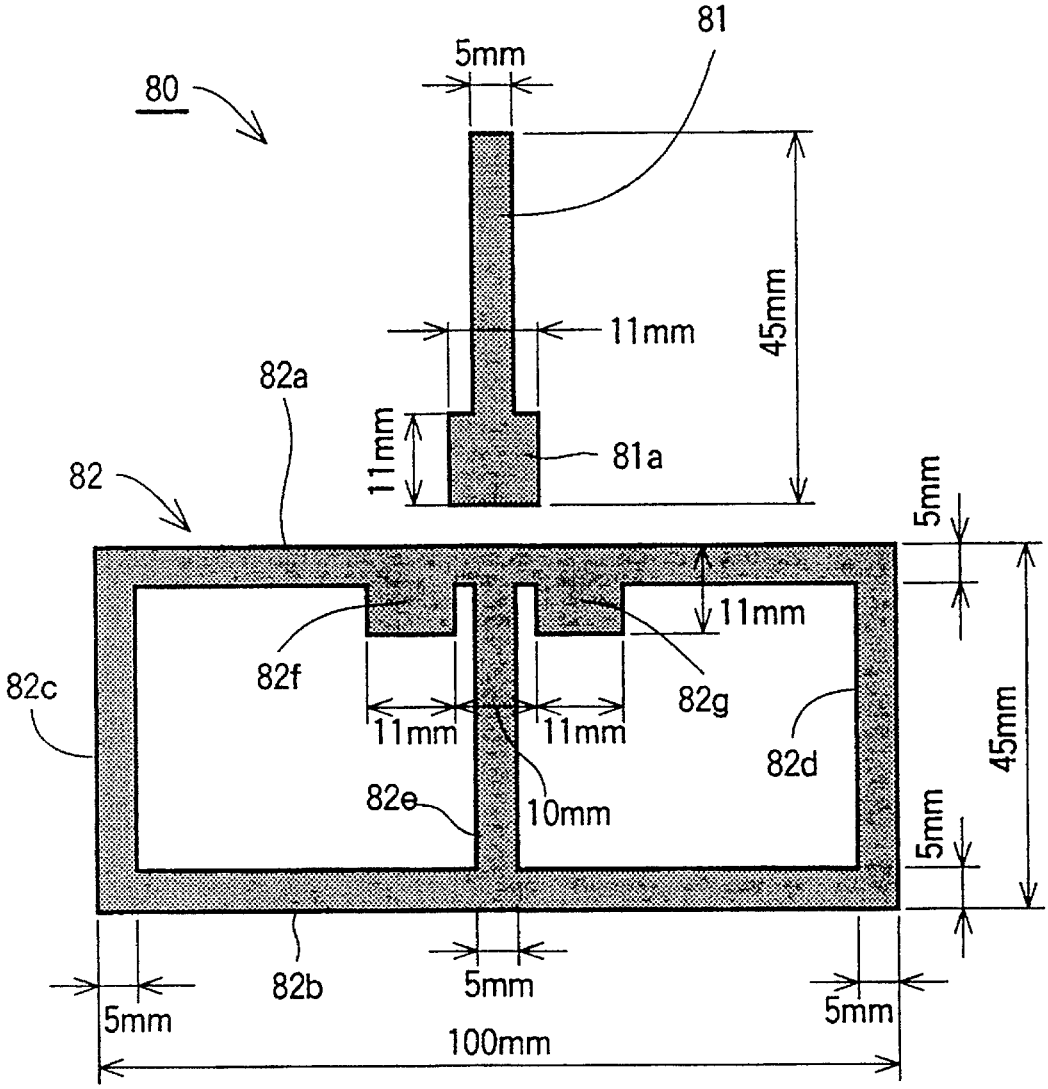
FIGS. 22 and 23 are front elevational views of a window glass antenna according to a seventh embodiment of the present invention.

FIG. 22 shows a window glass antenna according to a seventh embodiment of the present invention. The window glass antenna, generally denoted at 80, comprises a vertically elongate radiating pattern 81 and a horizontally elongate, centrally open ground pattern 82 spaced therefrom.

The radiating pattern 81 includes a connection terminal or feed electrode 81*a* at its lower end. The ground pattern 82 includes horizontal upper and lower pattern elements 82*a*, 82*b* spaced vertically from each other, vertical left and right pattern elements 82*c*, 82*d* spaced horizontally from each other and interconnecting the ends of the horizontal upper and lower pattern elements 82*a*, 82*b*, and a vertical central pattern element 82*e* interconnecting the horizontal upper and lower pattern elements 82*a*, 82*b* at their centers and aligned with the radiating pattern 81. The ground pattern 82 also has a pair of connection terminals or ground electrodes 82*f*, 82*g* joined to the upper pattern element 82*b* one on each side of the vertical central pattern element 82*e*, the ground electrodes 82*f*, 82*g* projecting toward the lower pattern element 82*b*. The pattern elements are typically of the dimensions shown in FIG. 22.

Figure 23:
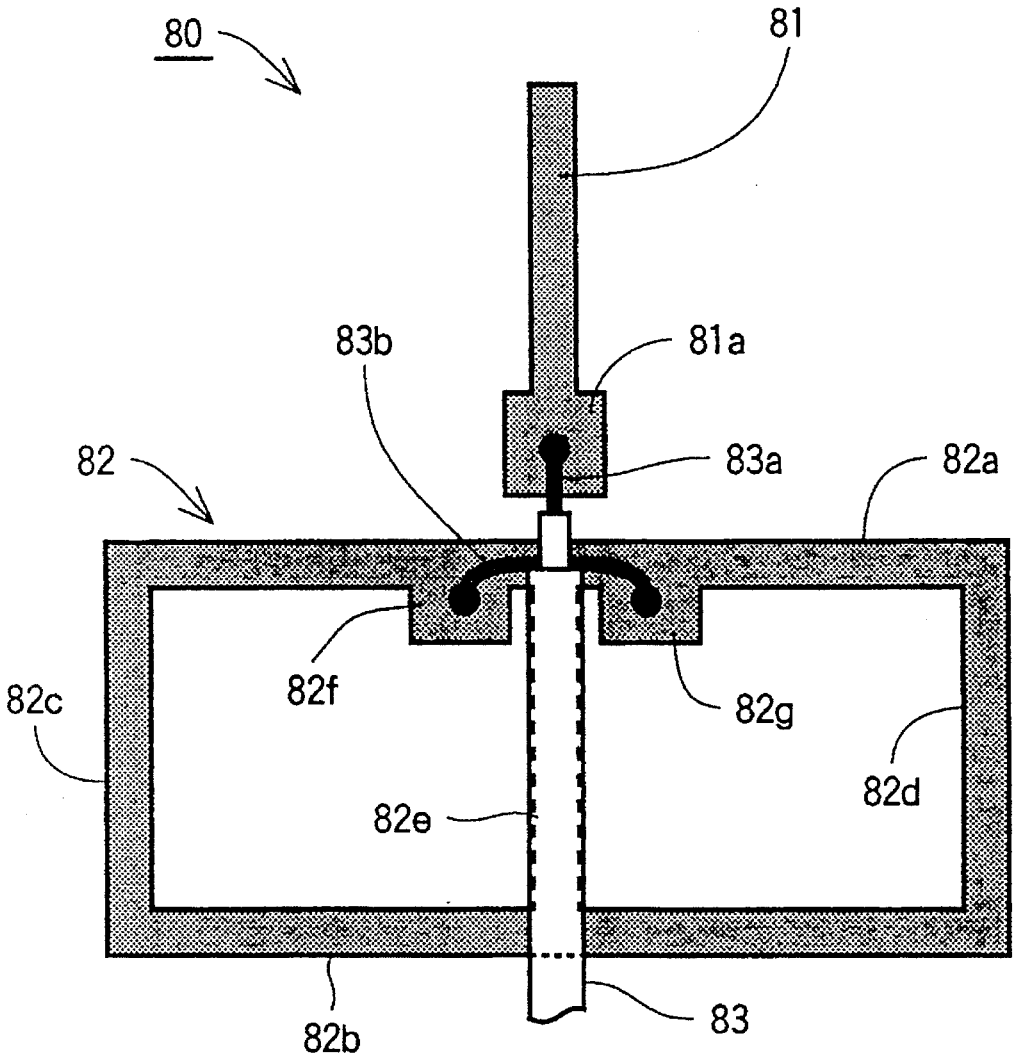

The window glass antenna 80 is connected to a coaxial cable 83 as shown in FIG. 23. The coaxial cable 83 comprises a core 83*a* and an outer conductor 83*b* in the form of braided wires. The core 83*a* is soldered or otherwise joined to the feed electrode 81*a* of the radiating pattern 81, whereas the outer conductor 83*b* is divided into two portions, which are soldered or otherwise joined to the ground electrodes 82*f*, 82*g*, respectively.

Figure 24:
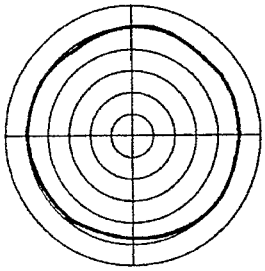
FIGS. 24(*a*) through 24(*i*) are diagrams illustrative of directivity patterns in a horizontal plane of the window glass antenna according to the seventh embodiment.
Figure 24:
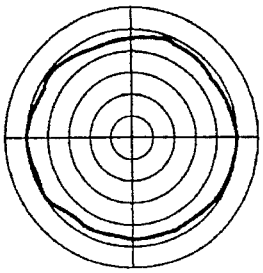
Figure 24:
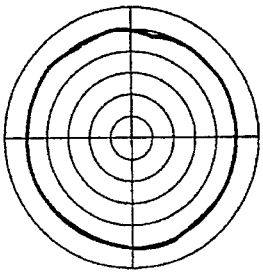
Figure 24:
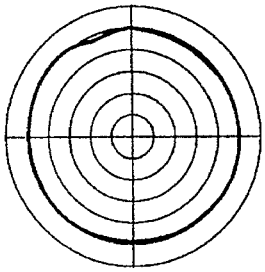
Figure 24:
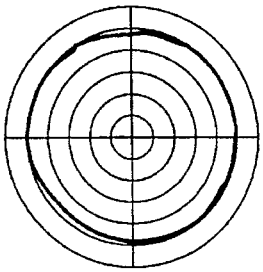
Figure 24:
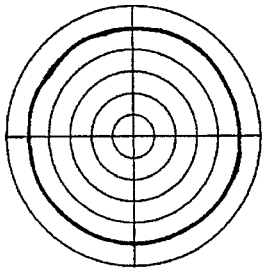
Figure 24:
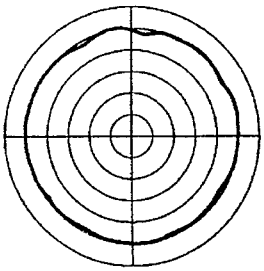
Figure 24:
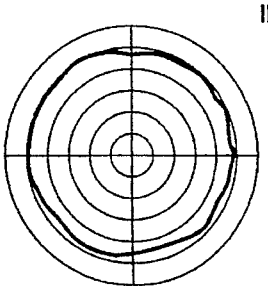
Figure 24:
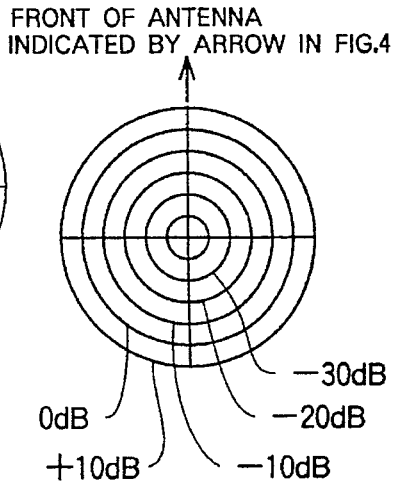

FIGS. 24(*a*) through 24(*i*) are illustrative of directivity patterns in a horizontal plane of the window glass antenna 80 according to the seventh embodiment at different frequencies, the directivity patterns being measured using the simulating system shown in FIG. 4. In the measurement, the window glass antenna 80 was formed of copper foils, and mounted on a glass panel having a vertical dimension of 300 mm, a horizontal dimension of 300 mm, and a thickness of 3.5 mm. FIG. 24(*i*) shows the direction and gains of each graph of FIGS. 24(*a*) through 24(*h*). The gains of the window glass antenna 80 were measured when the glass panel with the window glass antenna 80 was vertically oriented, i.e., when the angle thereof was 90°, on the iron plate G. Comparison between the directivity patterns shown in FIGS. 8(*a*) through 8(*h*) and those shown in FIGS. 24(*a*) through 24(*h*) indicates that the solid ground pattern and the centrally open ground pattern have substantially the same directivity characteristics.

Figure 25:
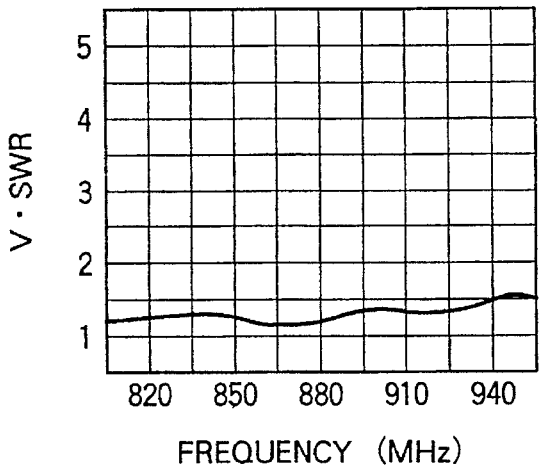
FIG. 25 is a graph showing the frequency characteristics of the voltage vs. standing wave ratio of the window glass antenna according to the seventh embodiment.

FIG. 25 shows the frequency characteristics of the voltage vs. standing wave ratio (V.SWR) of the window glass antenna 80 according to the seventh embodiment. Comparison between the frequency characteristics shown in FIGS. 9 and 25 shows that the voltage vs. standing wave ratio remains substantially the same even if the ground pattern is centrally open.

Figure 26:
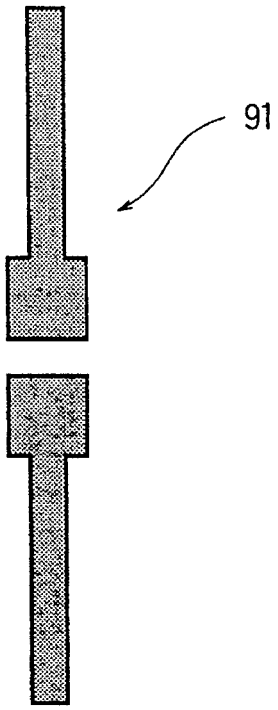
FIGS. 26, 27, and 28 are front elevational views of comparative antennas.
Figure 27:
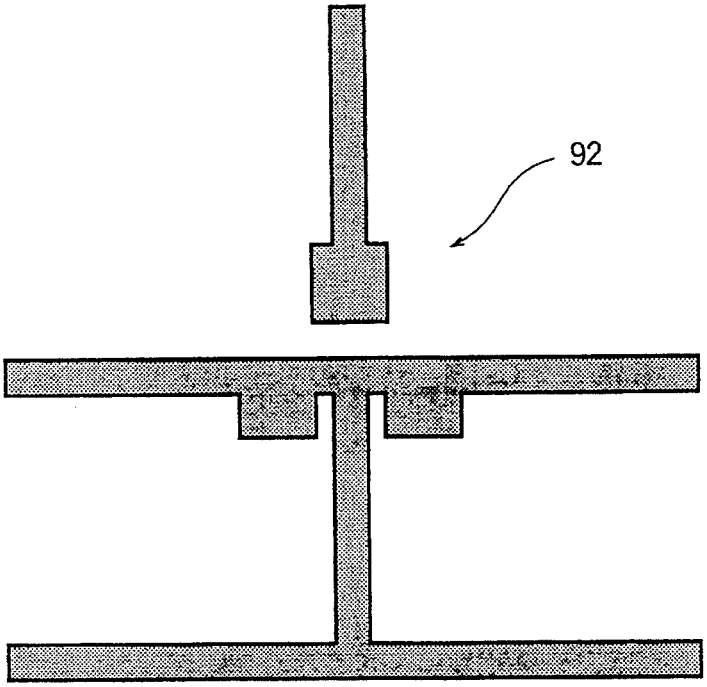
Figure 28:
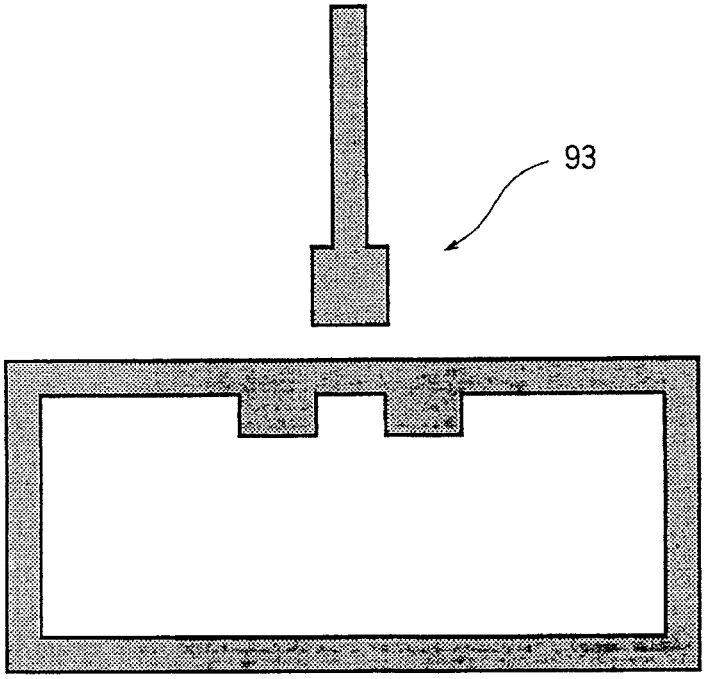

FIGS. 26 through 28 show comparative antennas used to evaluate effects which the upper, lower, left, and right pattern elements and the central pattern element of the ground pattern have on the average gain of the window glass antenna.

The comparative antenna, generally denoted at 91 in FIG. 26, is of a dipole configuration. The comparative antenna, generally denoted at 92 in FIG. 27, is devoid of the vertical left and right pattern elements 82*c*, 82*d* in FIG. 22. The comparative antenna, generally denoted at 93 in FIG. 28, is devoid of the vertical central pattern element 82*e* in FIG. 22.

Figure 29:
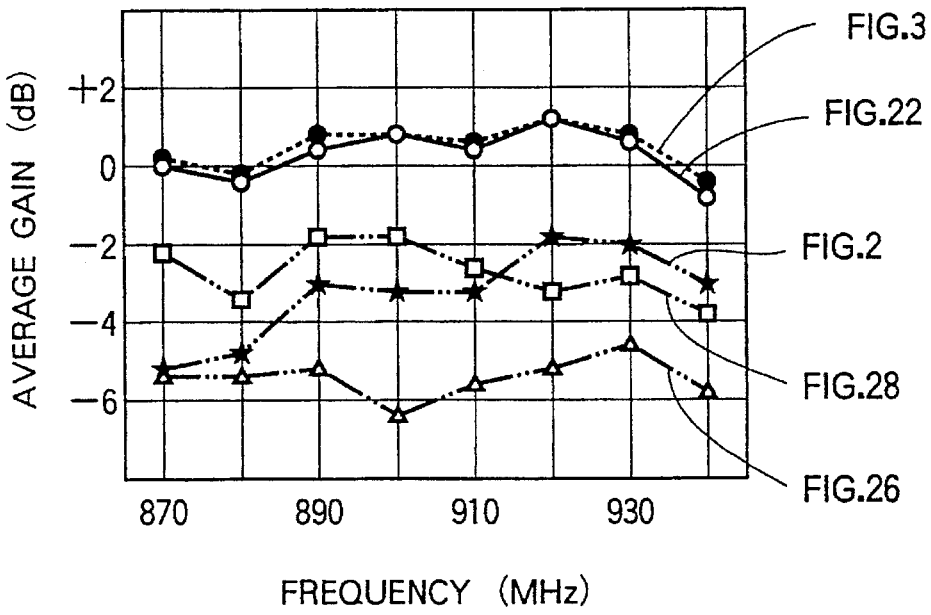
FIG. 29 is a graph showing the sensitivity vs. frequency characteristics, of the window glass antennas shown in FIGS. 3, 22, 26, 27, and 28.

FIG. 29 shows the frequency-dependent average gains, i.e., the sensitivity vs. frequency characteristics, of the various window glass antennas shown in FIGS. 3, 22, 26, 27, and 28 for comparison. As shown in FIG. 29, the antenna 11 with the solid ground pattern 14 shown in FIG. 3 and the antenna 80 with the centrally open ground pattern 82 shown in FIG. 22 have substantially the same sensitivity vs. frequency characteristics. It will be understood that the sensitivity drops by 2 dB to 4 dB when the vertical central pattern element 82*e* (FIG. 22) or the vertical left and right pattern elements 82*c*, 82*d* (FIG. 22) is dispensed with.

Figure 30:
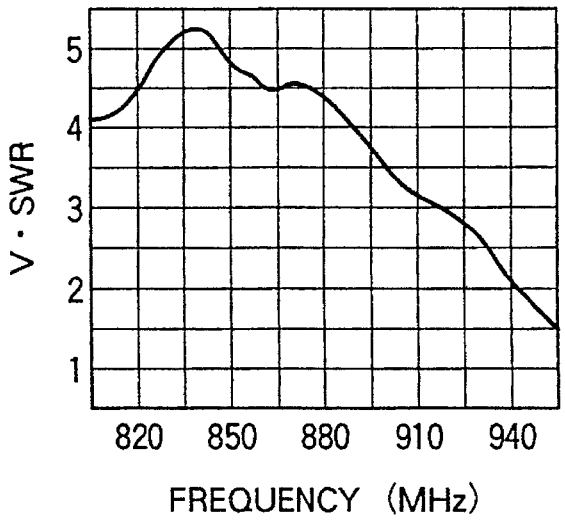
FIGS. 30, 31, and 32 are graphs showing the frequency characteristics of the voltage vs. standing wave ratios of the comparative window glass antennas illustrated in FIGS. 26, 27, and 28.
Figure 31:
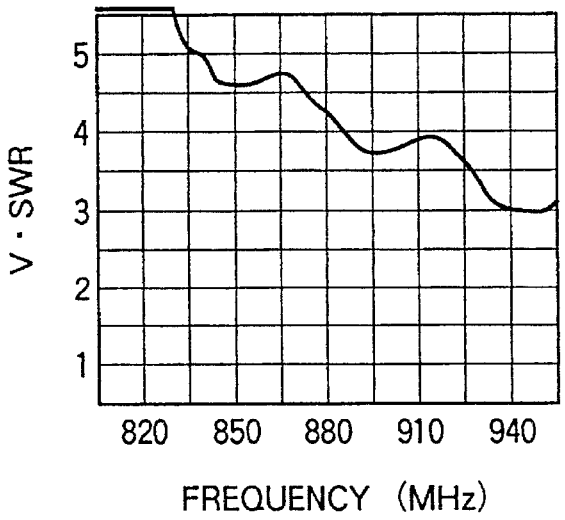
Figure 32:
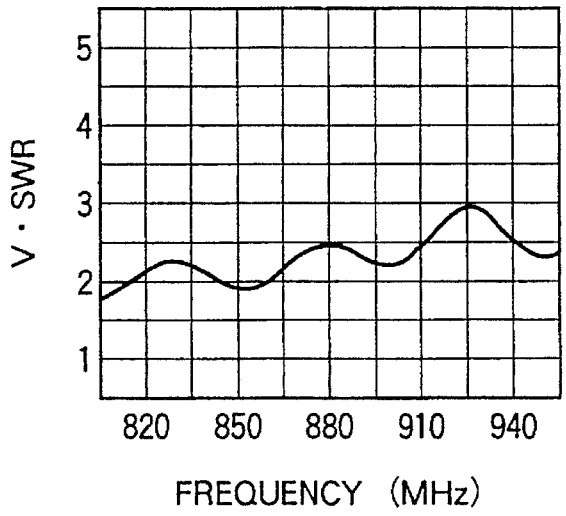

FIGS. 30, 31, and 32 show the frequency characteristics of the voltage vs. standing wave ratios of the comparative window glass antennas illustrated in FIGS. 26, 27, and 28. It can be seen from FIGS. 30 and 31 that matching cannot be achieved between the antenna and a receiver unless the vertical left and right pattern elements 82*c*, 82*d* are provided. Comparison between the graphs of FIGS. 32 and 25 indicates that the voltage vs. standing wave ratio is lowered to about 1.5 dB or less by the vertical central pattern element 82*e*.

Figure 33:
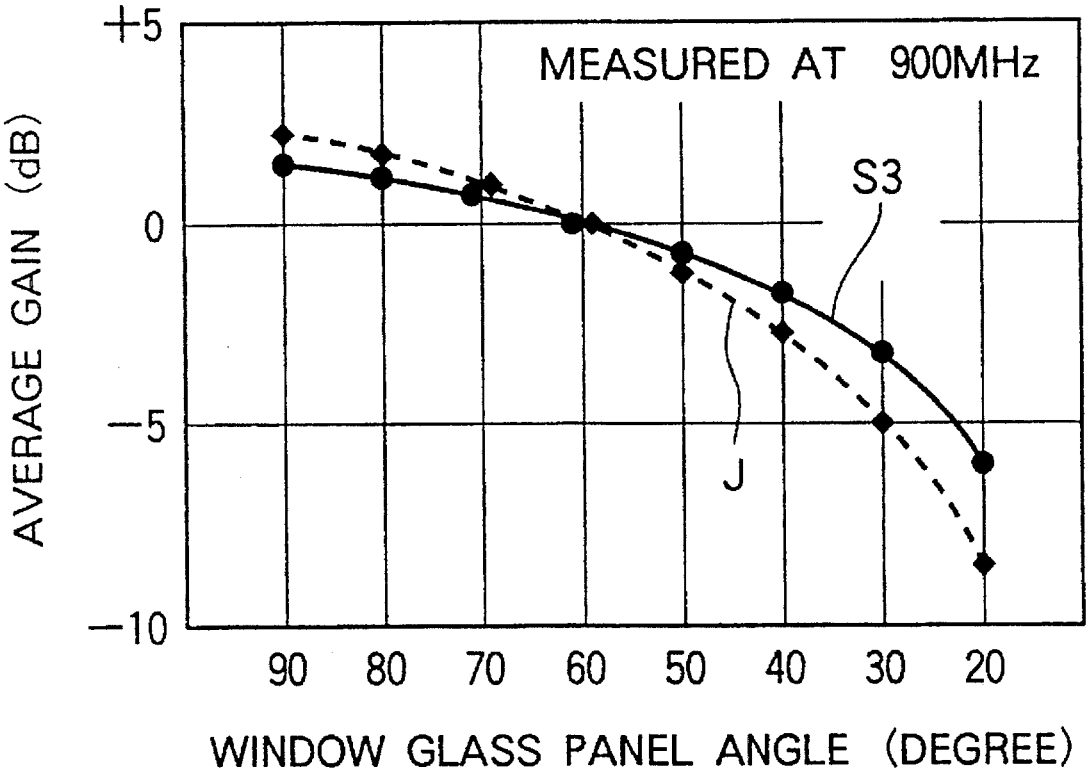
FIG. 33 is a graph showing the relationship between the angle of a window glass panel for supporting the window glass antenna according to the seventh embodiment and the conventional window glass antenna shown in FIG. 1, and the average antenna gain of the window glass antenna and the conventional window glass antenna.

FIG. 33 shows the relationship between the angle of a window glass panel for supporting the window glass antenna 80 according to the seventh embodiment shown in FIG. 22 and the conventional window glass antenna 101 shown in FIG. 1, and the average antenna gain of the window glass antenna 80 and the conventional window glass antenna 101. The average antenna gain was measured using the simulating system shown in FIG. 4 at the frequency of 900 MHz. A solid-line characteristic curve S3 in FIG. 33, which is indicative of the angle-dependent average gain of the window glass antenna 80 shown in FIG. 22, is the same as the solid-line characteristic curve S1 shown in FIG. 13, which indicates the angle-dependent average gain of the window glass antenna with the solid ground pattern.

Therefore, the window glass antenna 80 with the centrally open ground pattern 23*e*, which has substantially the same antenna performance as the window glass antenna with the solid ground pattern, may be mass-produced using the conventional glass bending process.

Figure 34:
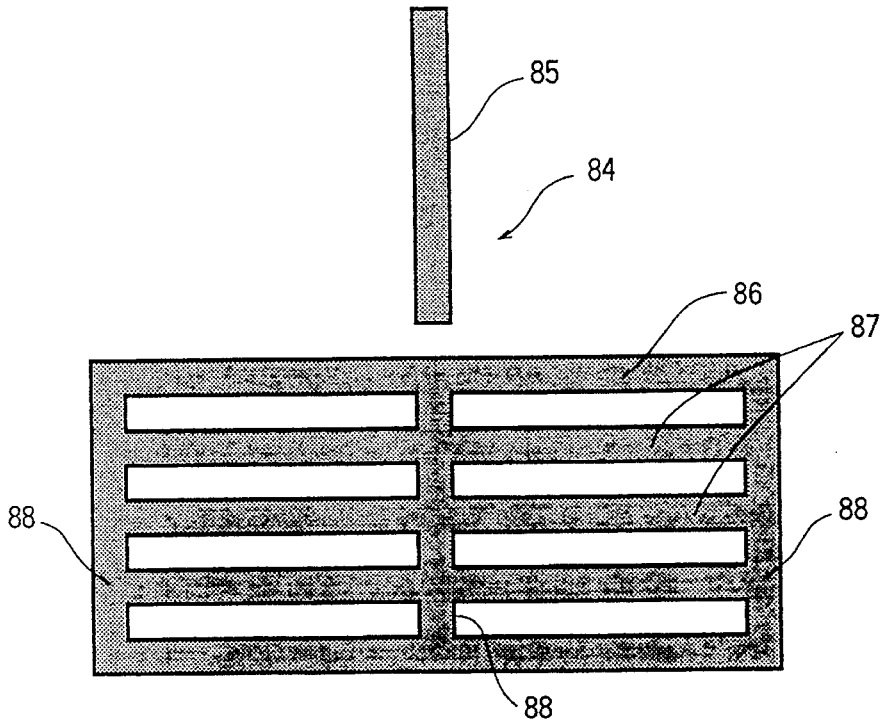
FIGS. 34(*a*) and 34(*b*) are front elevational views of modified window glass antennas.
Figure 34:
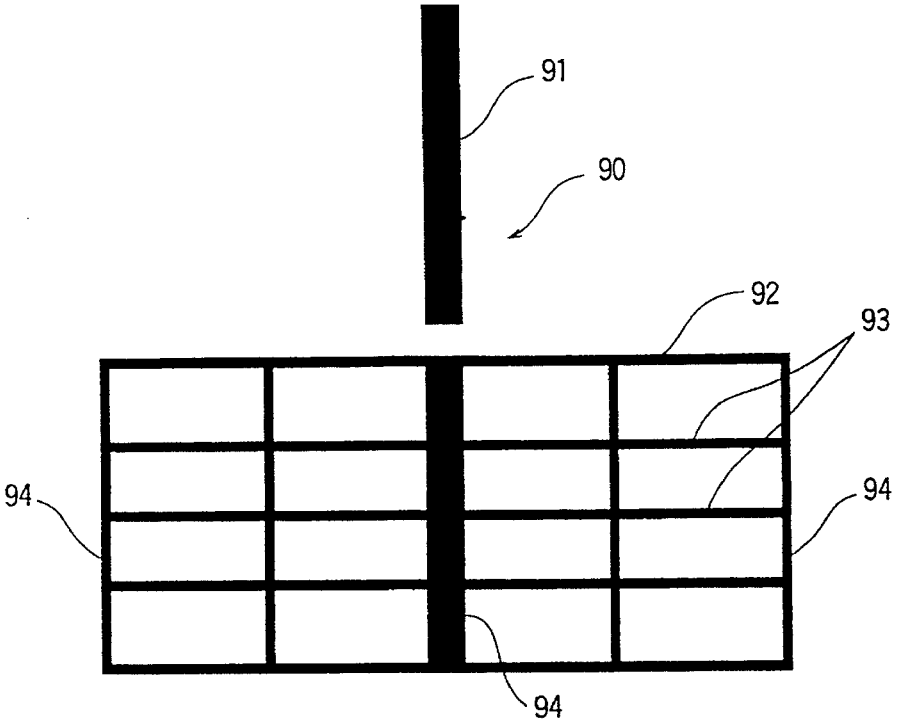

FIGS. 34(*a*) and 34(*b*) illustrate modified window glass antennas.

The window glass antenna, indicated at 84 in FIG. 34(*a*), comprises a vertically elongate radiating pattern 85 and a horizontally elongate ground pattern 86 spaced therefrom. The ground pattern 86 is of a grid-like shape with five, vertically spaced horizontal pattern elements 87 interconnected by three, horizontally spaced vertical pattern elements 88. The central vertical element 88 is aligned with the radiating pattern 85.

The window glass antenna, indicated at 90 in FIG. 34(*b*), comprises a vertically elongate radiating pattern 91 and a horizontally elongate ground pattern 92 spaced therefrom. The ground pattern 92 is of a mesh-like shape with five, vertically spaced horizontal pattern elements 93 interconnected by five, horizontally spaced vertical pattern elements 94. The central vertical element 94 is aligned with the radiating pattern 91.

It was experimentally confirmed that the antenna performance of the modified window glass antennas shown in FIGS. 34(*a*) and 34(*b*) was not reduced when the horizontal and vertical pattern elements of the ground patterns were narrower than the radiating patterns, e.g., they were 1 mm to 5 mm wide.

The window glass antennas described above have good reception and transmission performance when used on automobile window glass panels that are inclined about 20° to 40° to the horizontal plane.

Figure 35:
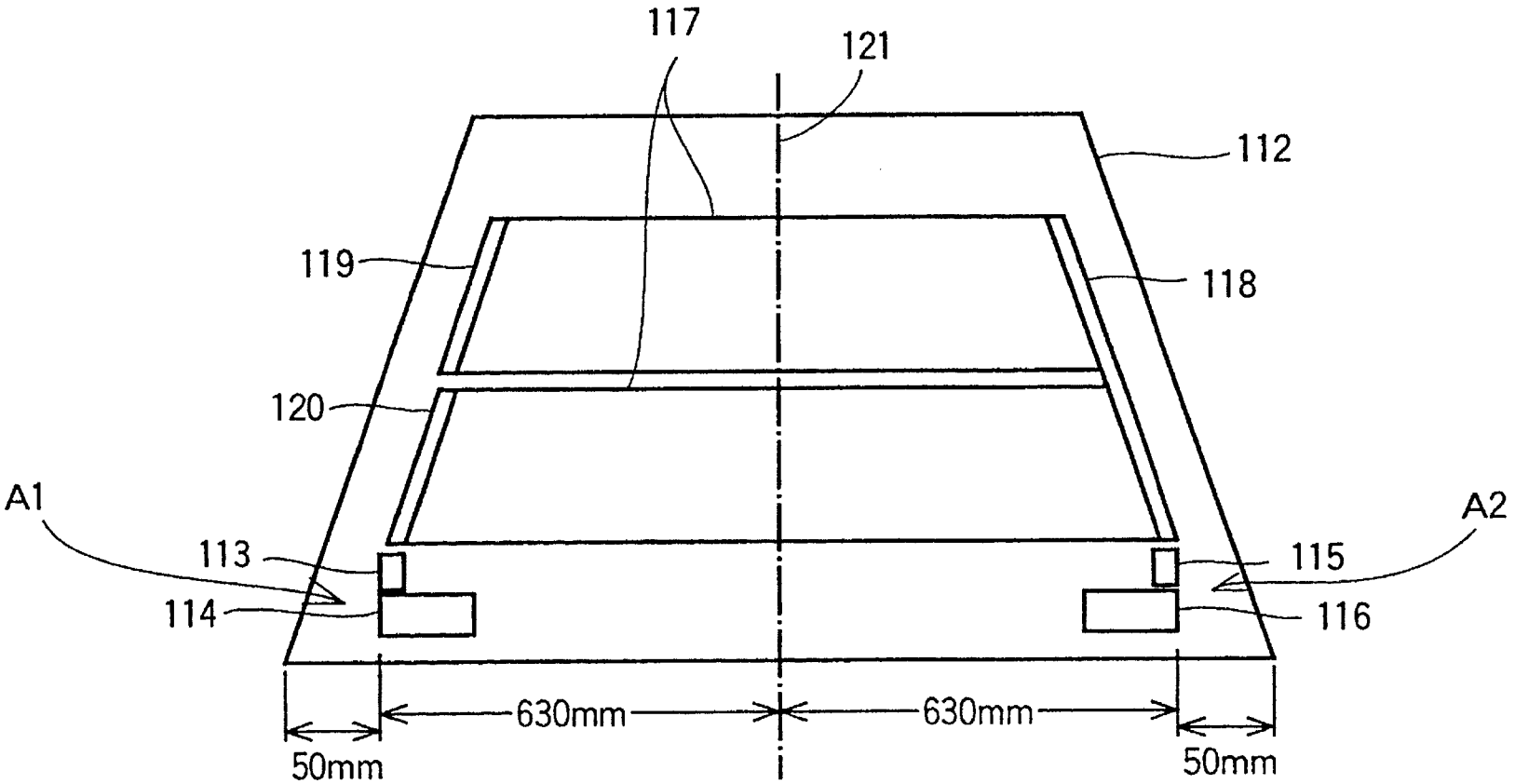
FIG. 35 is a front elevational view of a window glass antenna according to an eighth embodiment of the present invention.

FIG. 35 shows a window glass antenna according to an eighth embodiment of the present invention, the window glass antenna being shown as mounted on an automobile window glass panel and viewed from outside of the automobile.

The window glass antenna, generally denoted at 111 in FIG. 35, comprises a radiating pattern 113 and a ground pattern 114 that are disposed in a lower left location A on an automobile rear window glass panel 112, and/or a radiating pattern 115 and a ground pattern 116 that are disposed in a lower right location B on the automobile rear window glass panel 112. The window glass panel 112 supports a group of defrosting conductive wires 117 for heating the window glass panel 112. The defrosting conductive wires 107 are interconnected by a bus bar 118 on one end thereof, and can be supplied with a heating electric current from a pair of bus bars 119, 120 on the other end thereof. The patterns 113, 114, 115, 116 are shown as positioned below the defrosting conductive wires 117, i.e., at the lower left and right corners of the window glass panel 112. However, the patterns 113, 114, 115, 116 may be positioned above the defrosting conductive wires 117, i.e., at the upper left and right corners of the window glass panel 112.

The antenna patterns may be disposed in only one of the locations A1, A2. It is however preferable to position antenna patterns in two of four locations at the corners of the window glass panel 112, with the antenna patterns in the two locations operating as a diversity reception system.

As shown in FIG. 35, the locations A1, A2 are spaced from a vertical central axis 121 of the window glass panel 102 by a distance of 630 mm up to the outer edges of the patterns, and spaced from opposite side edges of the window glass panel 102 by a distance of 50 mm up to the outer edges of the patterns along the lower edge of the window glass panel 112.

The patterns 113, 114 in the location A1 and the patterns 115, 116 in the location A2 are symmetrical in shape. Therefore, only the patterns 113, 114 in the location A1 will be described below, and the patterns 115, 116 in the location A2 will not be described below.

Figure 36:
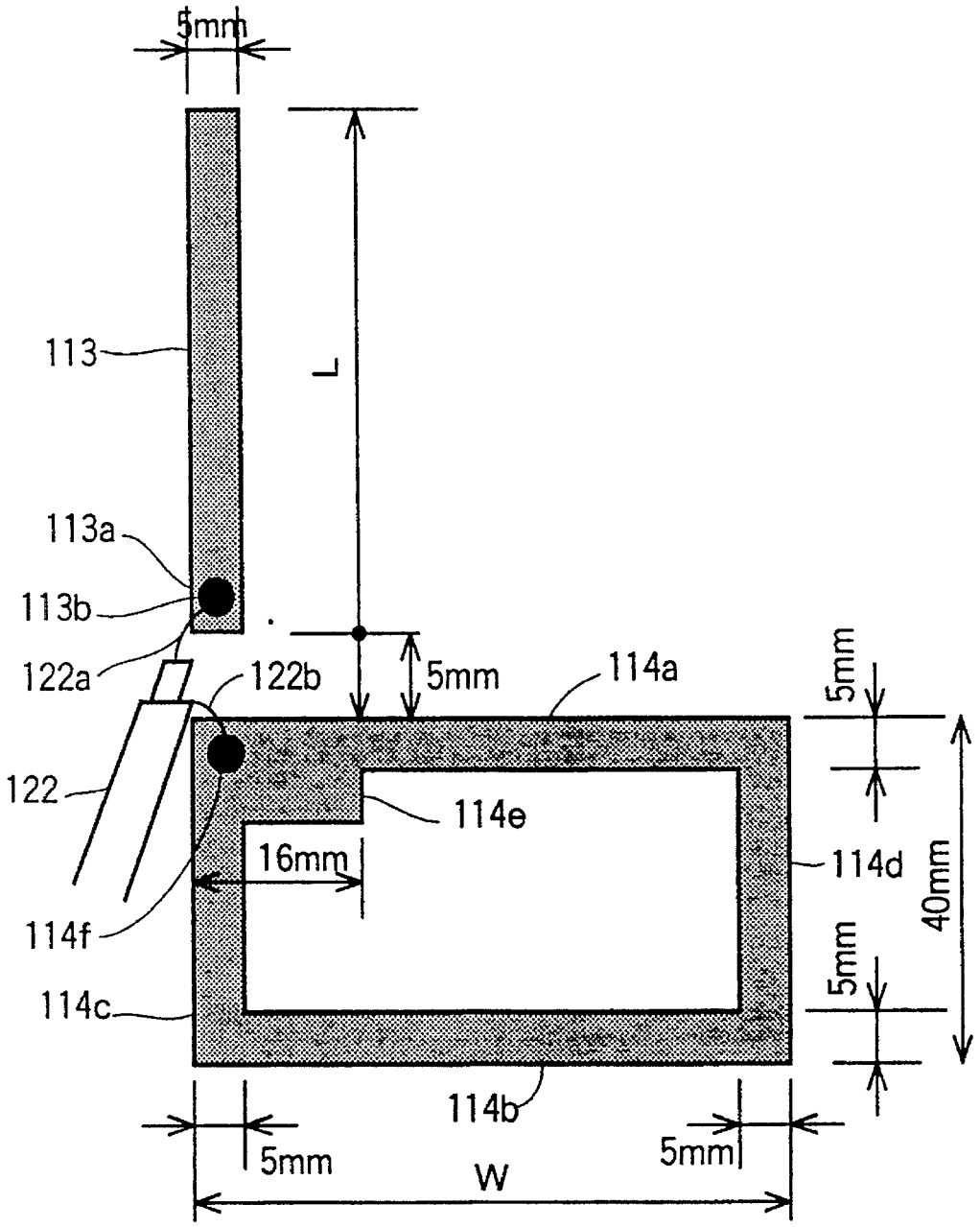
FIG. 36 is an enlarged front elevational view of radiating and ground patterns of the window glass antenna shown in FIG. 35.

As shown in FIG. 36, the radiating pattern 113 in the location A1 comprises a vertically elongate strip that extends perpendicularly to the lower edge of the window glass panel 112. The radiating pattern 113 has a connection terminal or feed electrode 113*a* on its lower end for connection to a core 122*a* of a coaxial cable 122 by soldering or the like, the feed electrode 113*a* having a feed point 113*b* thereon.

The ground pattern 114 is of a centrally open shape composed of horizontal upper and lower pattern elements 114*a*, 114*b* spaced vertically from each other, and vertical left and right pattern elements 114*c*, 114*d* spaced horizontally from each other and interconnecting the ends of the horizontal upper and lower pattern elements 114*a*, 114*b*.

In the location A1, the radiating pattern 113 is aligned with and positioned above the vertical left pattern element 114*c* close to the left-hand side edge of the window glass panel 102.

The ground pattern 114 also has a connection terminal or ground electrode 114*e* contiguous to the pattern elements 114*a*, 114*c* where they are joined to each other. Specifically, the ground electrode 114*e* projects downwardly from the upper pattern element 114*a* and to the left from the right pattern element 114*c*. The ground electrode 114*e* has a ground point 114*f* connected to an outer conductor 122*b* of the coaxial cable 122.

In FIG. 36, the radiating pattern 113 has a length L of 47.5 mm, and the ground pattern 114 has a height or length of 40 mm and a width W that is determined in a manner described below. The length of the ground pattern 114 should preferably be in the range of from 30 mm to 50 mm.

Figure 37:
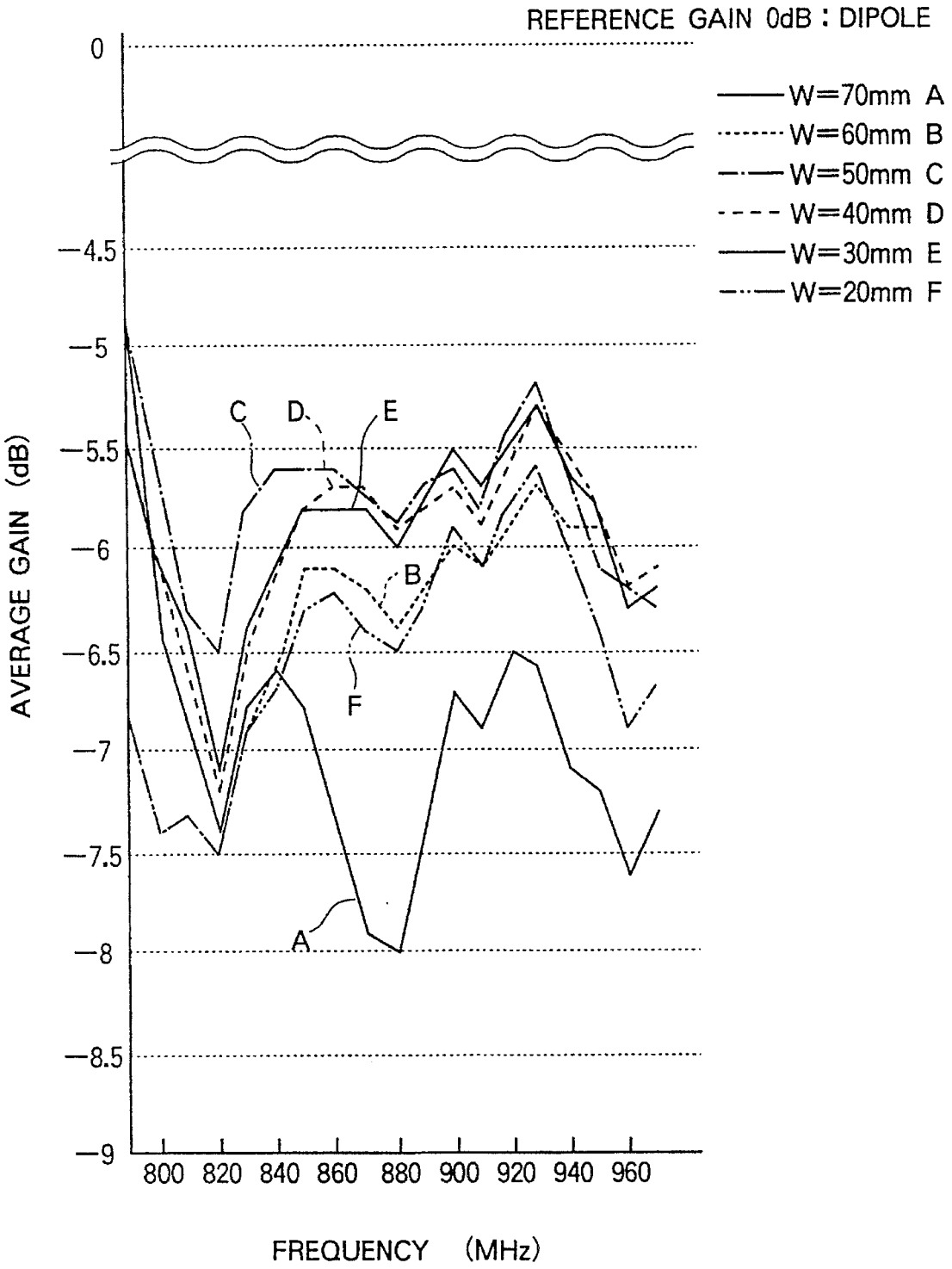
FIG. 37 is a graph showing the relationship between the width of the ground pattern shown in FIG. 36, the frequency, and the average gain.

FIG. 37 shows the relationship between the width of the ground pattern 114 shown in FIG. 36, the frequency, and the average gain. The graph of FIG. 37 has a horizontal axis representing the frequency and a vertical axis representing the average gain. In FIG. 37, characteristic curves A through F indicate frequency-dependent average gains when the ground pattern 114 had widths W of 70 mm, 60 mm, 50 mm, 40 mm, 30 mm, and 20 mm, respectively.

The average gain in FIG. 37 represents the ratio of the gain of the window glass antenna to the gain of a standard dipole antenna.

FIG. 38 is a table showing the relationship between the ground pattern width W and the average gain.

It will be seen from FIGS. 37 and 38 that the ground pattern width W has an optimum value of about 50 mm, i.e., ranging from 30 mm to 60 mm. Since the ground pattern width W of 50 mm corresponds to a quarter wavelength at 900 MHz provided that the shrinkage factor of the window glass antenna on the glass panel is 0.6, it is effective to provide a good antenna gain.

Figure 39:
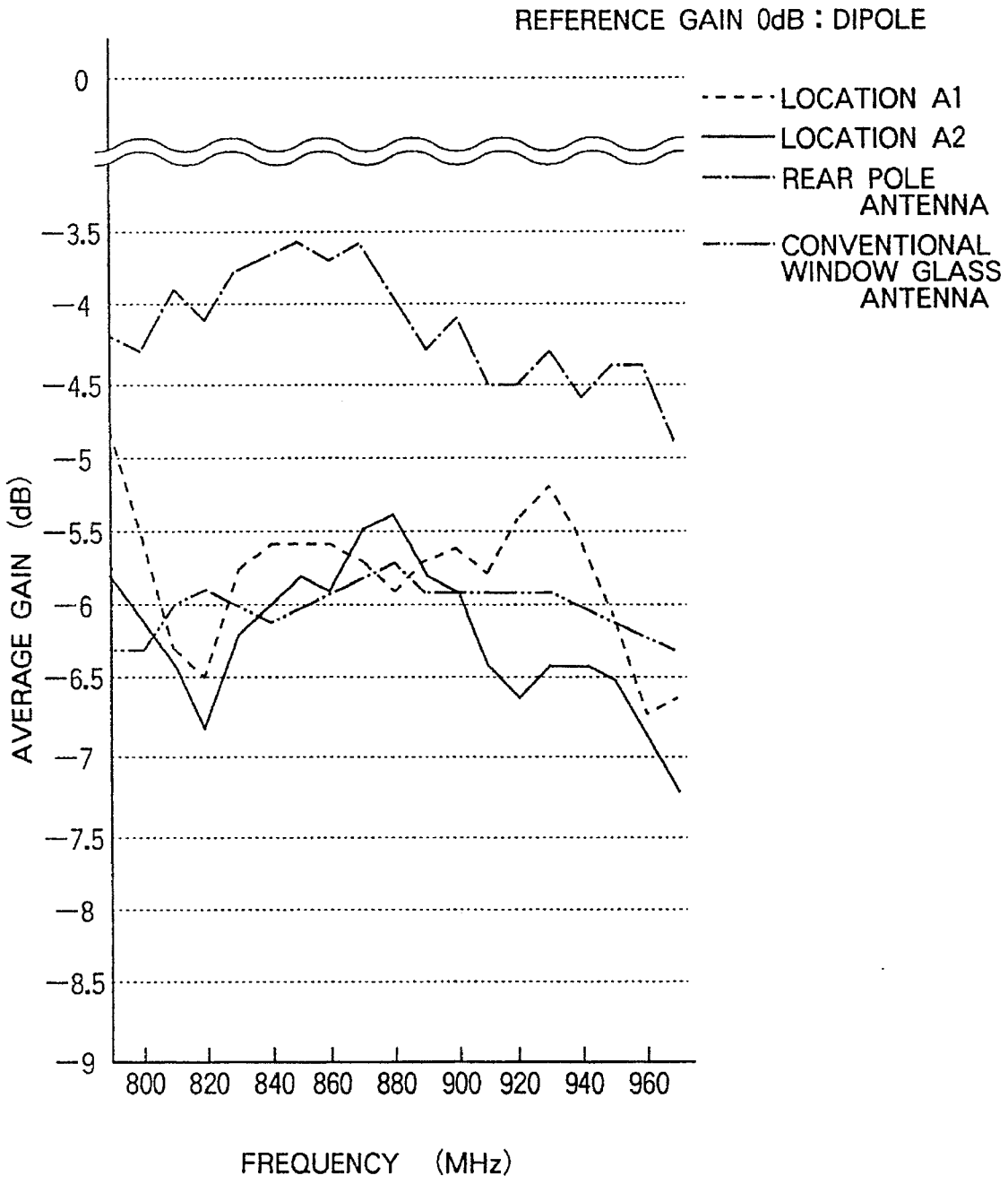
FIG. 39 is a graph showing average gains of various antennas.

FIG. 39 shows average gains of various antennas. Specifically, the graph of FIG. 39 shows the average gain of a window glass antenna positioned in the location A1, whose ground pattern has a width W of 50 mm, the average gain of a window glass antenna positioned in the location A2, whose ground pattern has a width W of 50 mm, the average gain of a conventional window glass antenna spaced 580 mm from the vertical central axis of the window glass panel and having a ground pattern width of 100 mm, and the average gain of a commercially available rear pole antenna for automobile telephone. The average gain in FIG. 39 represents the ratio of the gain of the window glass antenna to the gain of a standard dipole antenna.

FIG. 40 is a table showing the average gains of the various antennas. It can be seen from FIGS. 39 and 40 that the average gains of the window antennas positioned in the locations A1, A2 are equal to or higher than those of the conventional window glass antenna at each the frequencies at which the measurements were made. It can also be understood that the average gain of the window glass antenna according to the present invention is only about −2 dB lower than the rear pole antenna whose average gain is better.

Figure 41:
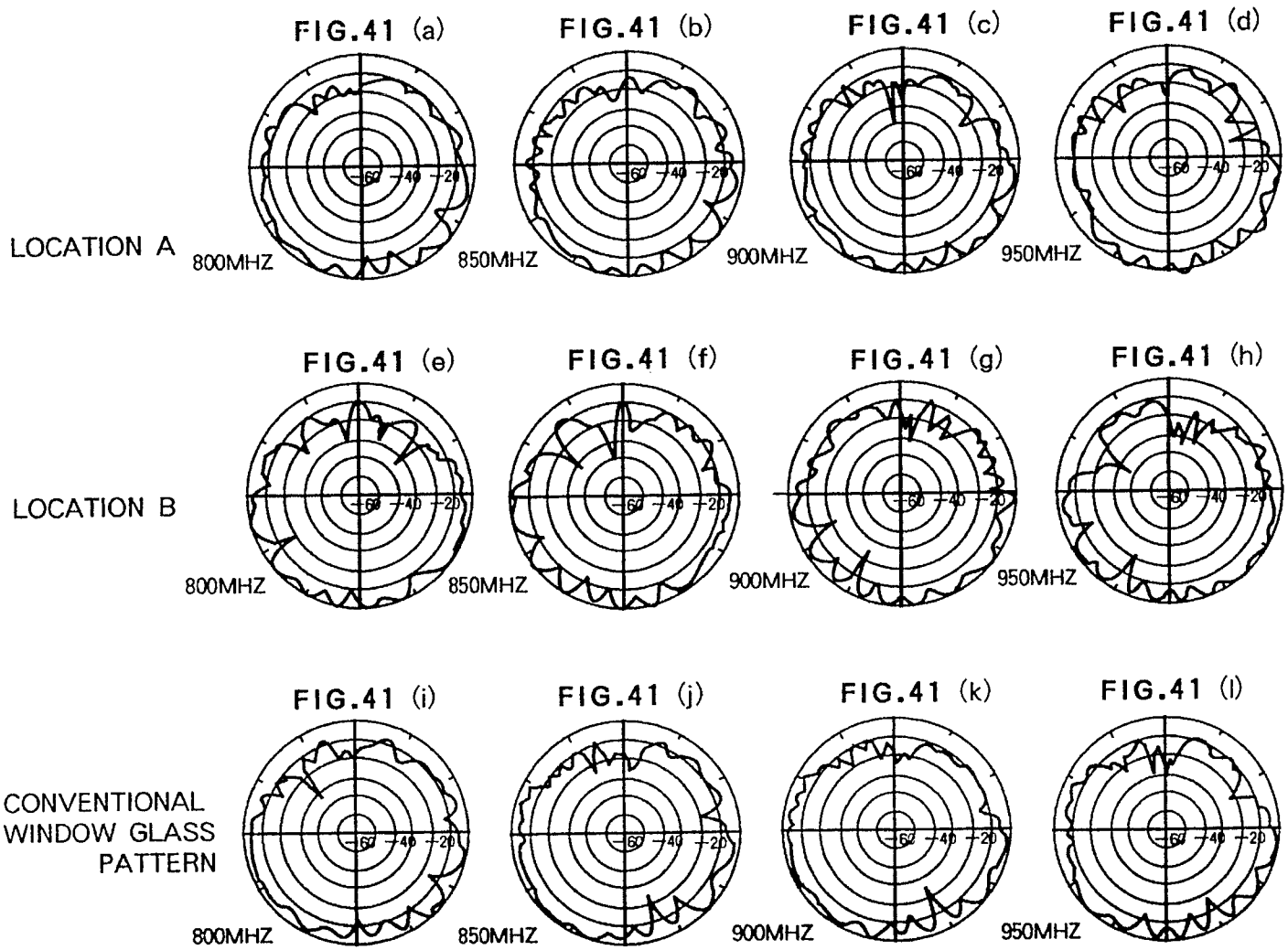
FIGS. 41(*a*) through 41(*l*) are diagrams showing directivity patterns of window glass antennas disposed in different locations according to the present invention and a conventional window glass antenna.

FIGS. 41(*a*) through 41(*l*) show directivity patterns of the window glass antennas in the locations A1, A2 and the conventional window glass antenna at the frequencies of 800 MHz, 850 MHz, 900 MHz, and 950 MHz. Study of FIGS. 41(*a*) through 41(*l*) indicates that the directivity characteristics of the window glass antennas in the locations A1, A2 are not substantially different from those of the conventional window glass antenna.

Figure 42:
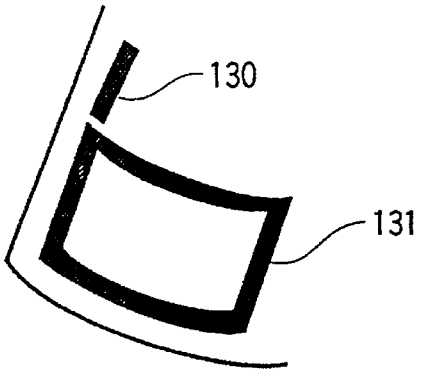
FIGS. 42(*a*) through 42(*g*) are front elevational views of modified window glass antennas.
Figure 42:
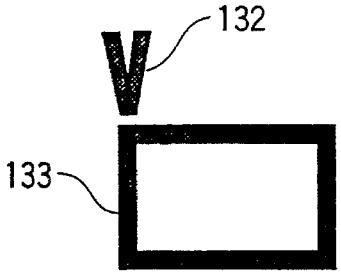
Figure 42:
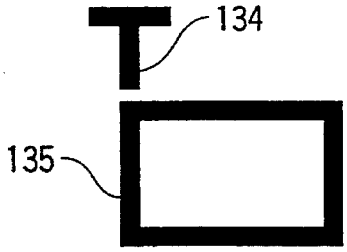
Figure 42:
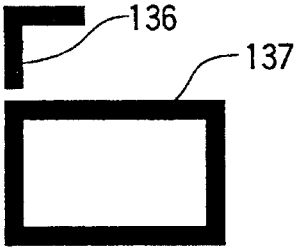
Figure 42:
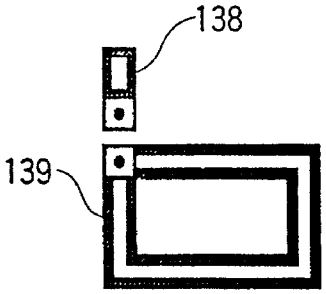
Figure 42:
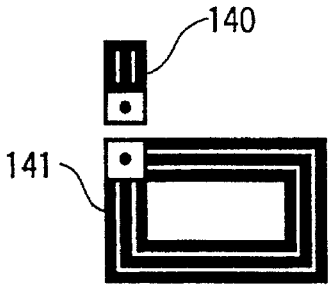
Figure 42:
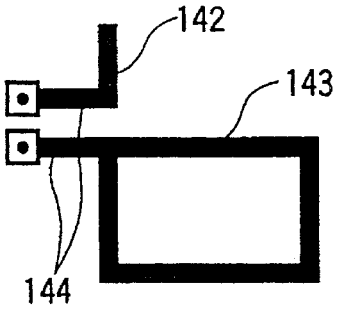

FIGS. 42(*a*) through 42(*g*) illustrate modified window glass antennas.

In FIG. 42(*a*), the window glass antenna comprises an elongate radiating pattern 130 and a centrally open arcuate ground pattern 131.

In FIG. 42(*b*), the window glass antenna comprises a V-shaped radiating pattern 132 and a centrally open rectangular ground pattern 133.

In FIG. 42(*c*), the window glass antenna comprises a T-shaped radiating pattern 134 and a centrally open rectangular ground pattern 135.

In FIG. 42(*d*), the window glass antenna comprises an inverted L-shaped radiating pattern 136 and a centrally open rectangular ground pattern 137.

In FIG. 42(*e*), the window glass antenna comprises a double-element radiating pattern 138 composed of two parallel pattern elements and a centrally open rectangular double-element ground pattern 139 composed of two parallel pattern elements.

In FIG. 42(*f*), the window glass antenna comprises a triple-element radiating pattern 140 composed of three parallel pattern elements and a centrally open rectangular triple-element ground pattern 141 composed of three parallel pattern elements.

In FIG. 42(*g*), the window glass antenna comprises an elongate radiating pattern 142 and a centrally open rectangular ground pattern 143. The radiating and ground patterns 142, 143 are connected to feed and ground points, respectively, through parallel conductors 144.

Although there have been described what are at present considered to be the preferred embodiments of the invention, it will be understood that the invention may be embodied in other specific forms without departing from the essential characteristics thereof. The present embodiments are therefore to be considered in all respects as illustrative, and not restrictive. The scope of the invention is indicated by the appended claims rather than by the foregoing description.

What is claimed is:

1. A window glass antenna device for use on a window glass panel supported on a ground frame, comprising:

a radiating pattern adapted to be mounted on the window glass panel and having a vertical length substantially equal to a quarter wavelength;

a ground pattern adapted to be mounted on the window glass panel in spaced relationship to said radiating pattern and having a vertical length ranging from 10 mm. to 50 mm. and a horizontal width ranging from a half wavelength to a three-quarter wavelength; and a ground conductor for electrically connecting said ground pattern to the ground frame, said ground conductor including a flexible conductive layer sandwiched between said ground pattern and said ground frame.

2. A window glass antenna device according to claim 1, further comprising a coaxial cable comprising an outer conductor connected to said ground conductor and a core electrically connected to said radiating pattern.

3. A window glass antenna device according to claim 2, wherein said core is connected to a feed point at a lower end of said radiating pattern, and said outer conductor is connected to a ground point at an upper edge of said ground pattern near said lower end of said radiating pattern.

4. A window glass antenna device according to claim 1, wherein said radiating pattern comprises a vertically elongate strip and said ground pattern comprises a horizontally elongate plate.

5. A window glass antenna device according to claim 1, wherein said radiating pattern is positioned on one side of said ground pattern and has a vertical longitudinal axis extending perpendicular to a horizontal longitudinal axis of said ground pattern.

6. A window glass antenna device according to claim 5, wherein said radiating pattern is positioned upwardly of said ground pattern.

7. A window glass antenna device according to claim 1, wherein each of said radiating and ground patterns comprises a copper foil.

8. A window glass antenna device according to claim 1, wherein said ground pattern comprises a horizontally elongate solid plate.

9. A window glass antenna device according to claim 1, wherein said ground pattern comprises a horizontally elongate, centrally open plate.

10. A window glass antenna device according to claim 1, wherein said ground conductor comprises a copper foil.

11. A window glass antenna device according to claim 10, further comprising a coaxial cable comprising an outer conductor connected to said ground pattern and a core electrically connected to said radiating pattern.

12. A window glass antenna device according to claim 11, wherein said core is connected to a feed point at a lower end of said radiating pattern, and said outer conductor is connected to a ground point at an upper edge of said ground pattern near said lower end of said radiating pattern.

13. A window glass antenna device according to claim 1, wherein said ground conductor comprises a pair of spaced ground wires.

14. A window glass antenna device according to claim 13, further comprising a coaxial cable comprising an outer conductor connected to said ground pattern and a core electrically connected to said radiating pattern.

15. A window glass antenna device according to claim 14, wherein said core is connected to a feed point at a lower end of said radiating pattern, and said outer conductor is connected to a ground point at an upper edge of said ground pattern near said lower end of said radiating pattern.

16. A window glass antenna device according to claim 1, wherein said radiating pattern comprises a vertically elongate strip and said ground pattern comprises a horizontally elongate, centrally open plate.

17. A window glass antenna device according to claim 16, wherein said horizontal sides of said ground pattern comprise a pair of horizontal upper and lower pattern elements spaced vertically from each other, said vertical sides of said ground pattern comprise a pair of vertical left and right pattern elements spaced horizontally from each other and interconnecting ends of said horizontal upper and lower pattern element, and said ground pattern further comprises a vertical central pattern element interconnecting said horizontal upper and lower pattern elements at centers thereof and aligned with said radiating pattern.

18. A window glass antenna device according to claim 17, wherein said ground pattern also includes a pair of ground electrodes joined to said horizontal upper pattern element and positioned one on each side of said vertical central pattern element, said ground conductor being connected to said ground electrodes.

19. A window glass antenna device according to claim 18, said radiating pattern has a feed electrode on a lower end thereof adjacent to said ground pattern, further comprising a coaxial cable comprising a core connected to said feed electrode of said radiating pattern and an outer conductor as said ground conductor.

20. A window glass antenna for use on a window glass panel and having a vertical length substantially equal to a quarter wavelength; and a ground pattern adapted to be mounted on the window glass panel in spaced relationship to said radiating pattern and having a horizontal width substantially equal to a quarter wavelength, and a vertical length ranging from 10 mm. to 50 mm. said ground pattern being of a centrally open shape, said radiating and ground patterns being adapted to be positioned near one vertical edge of the window glass panel, said ground pattern forming a rectangular shape with parallel vertical sides and parallel horizontal sides.

21. A window glass antenna according to claim 20, wherein said radiating pattern comprises a vertically elongate strip aligned with a vertical edge of said ground pattern.

22. A window glass antenna according to claim 20, wherein said radiating pattern comprises a vertically elongate strip.

23. A window glass antenna according to claim 20, wherein said radiating pattern is of a V shape.

24. A window glass antenna according to claim 20, wherein said radiating pattern is of a T shape.

25. A window glass antenna according to claim 20, wherein said radiating pattern is of an inverted L shape.

26. A window glass antenna according to claim 20, wherein said radiating pattern comprises a double-element pattern.

27. A window glass antenna according to claim 20, wherein said radiating pattern comprises a triple-element pattern.

28. A window glass antenna device for use on a window glass panel supported on a ground frame, comprising:

a radiating pattern adapted to be mounted on the window glass panel and having a vertical length substantially equal to a quarter wavelength;

a ground pattern adapted to be mounted on the window glass panel in spaced relationship to said radiating pattern and having a vertical length ranging from 10 mm. to 50 mm. and a horizontal width ranging from a half wavelength to a three-quarter wavelength; and a ground conductor for electrically connecting said ground pattern to the ground frame, said ground conductor including a flexible contact strip sandwiched between said ground pattern and said ground frame.

29. A window glass antenna device for use on a window glass panel supported on a ground frame, comprising:

a radiating pattern adapted to be mounted on the window glass panel and having a vertical length substantially equal to a quarter wavelength;

a ground pattern adapted to be mounted on the window glass panel in spaced relationship to said radiating pattern and having a vertical length ranging from 10 mm. to 50 mm. and a horizontal width ranging from a half wavelength to a three-quarter wavelength; and a ground conductor for electrically connecting said ground pattern to the ground frame, said ground conductor including a resilient ground strip held in contact with said ground pattern, said antenna device further comprising a resilient feed strip held in contact with said radiating pattern.

30. A window glass antenna for use on a window glass panel, comprising:

a radiating pattern adapted to be mounted on the window glass panel and having a vertical length substantially equal to a quarter wavelength; and a ground pattern adapted to be mounted on the window glass panel in a spaced relationship to said radiating pattern and having a vertical length ranging from 10 mm. to 50 mm. and a horizontal width ranging from a half wavelength to a three-quarter wavelength, said ground pattern forming a rectangular shape with parallel vertical sides and parallel horizontal sides, said ground pattern comprising a horizontally elongate, centrally-open rectangular plate.

31. A window glass antenna according to claim 30, wherein said horizontal sides of said ground pattern comprises a pair of horizontal upper and lower pattern elements spaced vertically from each other, said vertical sides of said ground pattern comprises a pair of vertical left and right pattern elements spaced horizontally from each other and interconnecting ends of said horizontal upper and lower pattern elements, and said ground pattern further comprises a vertical central pattern element interconnecting said horizontal upper and lower pattern elements at centers thereof and aligned with said radiating pattern.

32. A window glass antenna for use on a window glass panel, comprising:

a radiating pattern adapted to be mounted on the window glass panel and having a vertical length substantially equal to a quarter wavelength; and a ground pattern adapted to be mounted on the window glass panel in spaced relationship to said radiating pattern and having a vertical length ranging from 10 mm. to 50 mm. and a horizontal width ranging from a half wavelength to a three-quarter wavelength, said ground pattern forming a rectangular shape with parallel vertical sides and parallel horizontal sides, said ground pattern comprising a horizontally elongate grid-shaped rectangular plate comprising a plurality of vertically spaced horizontal pattern elements and a plurality of horizontally spaced vertical pattern elements interconnecting said horizontal pattern elements.

33. A window glass antenna according to claim 32, wherein one of said vertical pattern elements is aligned with said radiating pattern.

34. A window glass antenna for use on a window glass panel, comprising:

a radiating pattern adapted to be mounted on the window glass panel and having a vertical length substantially equal to a quarter wavelength; and a ground pattern adapted to be mounted on the window glass panel in spaced relationship to said radiating pattern and having a vertical length ranging from 10 mm. to 50 mm. and a horizontal width ranging from a half wavelength to a three-quarter wavelength, said ground pattern forming a rectangular shape with parallel vertical sides and parallel horizontal sides, said ground pattern comprising a horizontally elongate mesh-shaped rectangular plate comprising a plurality of vertically spaced horizontal pattern elements and a plurality of horizontally spaced vertical pattern elements interconnecting said horizontal pattern elements.

35. A window glass antenna according to claim 34, wherein one of said vertical pattern elements is aligned with said radiating pattern.

* * * * *